US010582825B2

(12) United States Patent
Paavola

(10) Patent No.: US 10,582,825 B2
(45) Date of Patent: Mar. 10, 2020

(54) MODULAR SURFACE MAINTAINER

(71) Applicant: Dean Paavola, Maricopa, AZ (US)

(72) Inventor: Dean Paavola, Maricopa, AZ (US)

( * ) Notice: Subject to any disclaimer, the term of this patent is extended or adjusted under 35 U.S.C. 154(b) by 212 days.

(21) Appl. No.: 15/725,807

(22) Filed: Oct. 5, 2017

(65) Prior Publication Data

US 2018/0098677 A1 Apr. 12, 2018

Related U.S. Application Data

(60) Provisional application No. 62/404,967, filed on Oct. 6, 2016.

(51) Int. Cl.

| | |
|---|---|
| ***A47L 11/24*** | (2006.01) |
| ***A47L 11/40*** | (2006.01) |
| ***A47L 11/26*** | (2006.01) |

(52) U.S. Cl.

CPC ..... *A47L 11/24* (2013.01); *A47L 11/26* (2013.01); *A47L 11/4005* (2013.01); *A47L 11/4008* (2013.01); *A47L 11/4011* (2013.01); *A47L 11/4038* (2013.01); *A47L 11/4058* (2013.01); *A47L 11/4066* (2013.01); *A47L 11/4069* (2013.01); *A47L 11/4075* (2013.01)

(58) Field of Classification Search

CPC ..... A47L 11/24; A47L 11/26; A47L 11/4005; A47L 11/4008; A47L 11/4011; A47L 11/4038; A47L 11/4058; A47L 11/4066; A47L 11/4069; A47L 11/4075

See application file for complete search history.

(56) References Cited

U.S. PATENT DOCUMENTS

| | | | | |
|---|---|---|---|---|
| 4,651,378 A * | 3/1987 | Serou | A47L 11/16 | 15/49.1 |
| 8,343,654 B2 * | 1/2013 | Churchill | H01M 2/1022 | 429/163 |
| 8,661,613 B2 * | 3/2014 | Marsh | A47L 9/0444 | 15/351 |
| 2006/0064844 A1 * | 3/2006 | Venard | A47L 11/4061 | 15/340.3 |

* cited by examiner

*Primary Examiner* — Shay Karls
(74) *Attorney, Agent, or Firm* — Bycer Law, PLC; Matthew L. Bycer

(57) ABSTRACT

An apparatus is provided which is capable of cleaning soiled concrete or other hard surfaces using significantly less water and detergent than typical pressure washers. A dual brush mode allows for more surface treatment. A safety electrical system allows the system to be used safely outdoors. The highly maneuverable maintainer utilizes industry standard components from floor maintenance equipment integrated with a horizontally stable wheeled platform, as well as, an adjustable and wear-compensating suspension system that can accommodate a variety of surfaces. The result is a low noise, low carbon footprint, low resource apparatus that moves easily in any direction while providing direct rotary brush scrubbing to clean soiled concrete or other hard surfaces.

12 Claims, 20 Drawing Sheets

PRIOR ART

MODULAR SURFACE MAINTAINER

CROSS REFERENCE TO RELATED APPLICATION

The present application includes subject matter disclosed in and claims priority to a provisional application entitled "ROTARY SURFACE CLEANER" filed Oct. 6, 2016 and assigned Ser. No. 62/404,967 describing an invention made by the present inventor and incorporated herein by reference.

FIELD OF INVENTION

The present invention relates to surface cleaners. The present invention more particularly relates to flat surface cleaners.

BACKGROUND OF THE DISCLOSURE

As water becomes a scarcer and more valuable resource, re-evaluating how we use water is of vital importance. The scarcity of water in some regions has led to significant restrictions on water use for heretofore commonplace activities such as lawn and property maintenance due to its solvency properties. The pressure washer is a common machine used by both private and commercial entities to maintain the appearance and cleanliness of their homes and businesses. The pressure washer converts a low pressure water source, typically municipal water, into a concentrated high velocity stream that is very effective at removing dirt and grime. Detergents and water heaters are often used to augment the pressure washer to increase the cleaning effectiveness against oil-based or stubborn stains. The cleaning action of the pressure washer is derived primarily from the velocity and volume of water that flows from the specifically designed tip of the sprayer wand. While it may be a useful cleaning tool, the environmental impact of the pressure washer can be fairly significant. Together, the multitude of pressure washers used daily add both noise and hydrocarbon pollution to our environment. Additionally, with typical volumetric water use ranging from 2.5 to 6 gallons per minute (150 to 360 gallons per hour), excessive water is consumed every day for cleaning private and commercial properties.

An apparatus is needed that eliminates the negative effects of the pressure washer (noise, carbon pollution and excessive water use) while providing similar cleaning results for soiled concrete or other hard surfaces.

A power washer alternative that addresses all of the downsides currently exists in the marketplace. The low speed rotary floor maintainer, typically used by janitorial staff for cleaning and buffing floors, is capable of cleaning soiled concrete surfaces using far less water and detergent. However, the floor maintainer is a dynamic device that forces the user to clean in a side-to-side motion based on the position of the handle. While the rotary brush is active, straight line motion (forward or reverse) is very difficult and not practical for extended periods of use. The side-to-side movement makes using the rotary floor maintainer in confined spaces or along narrow pathways impractical. A device is needed that avoids the disadvantages of both the pressure washer and the floor maintainer but is highly maneuverable and provides good cleaning action for soiled concrete and other hard surfaces.

It is therefore an object of the present invention to provide a cleaner with an ease of use in many directions along a plane, or other surface.

It is another object of the present invention to provide a cleaner that can handle various surfaces.

It is a further object of the present invention to provide a cleaner than can be easily moved in many directions and/or in confined spaces.

SUMMARY OF THE INVENTION

The present invention includes rotary surface scrubber, or more broadly a surface maintainer, that can be used to buff, polish, brush, burnish, wash, clear, sand, or otherwise maintain a surface. The surface can be a floor, ground, or any lower surface upon which the invention may rest. The invention includes a scrubbing head assembly that includes a power source to rotate the brushes (such as an electric motor) that can accept alternating current (AC) (or less preferably direct current (DC)) from an external source (an onboard DC battery). The motor is preferably attached to a transmission to rotate the brush(es) at a set preferred speed range.

A chassis is provided with a handle assembly that may include a lower portion affixed to the chassis and an upper portion that can be removed/replaced, etc. The system is modular in that it may be used as a single brusher, or dual brusher. In the single brusher mode, the upper handle affixes to a single chassis, whereas in the dual mode, the upper handle may affix to two separate brusher chassis. The chassis includes a plurality of wheels and/or casters with mounting provisions for a scrubbing head assembly and control handle. A rotation limiting feature, such as a pin or other affixing means, may be used to connect the motor (preferably via a flange) to the top of the chassis thereby providing a controlled amount of rotational compliance which serves to damp transient vibrations. A suspension system is preferably used in conjunction with the rotation limiting feature to partially support the weight of the motor, transmission, and brush, etc. The suspension system may provide fixed or adjustable support in many, or certain predefined, tension levels—serving to modulate the force of the brush against the surface being cleaned.

The upper handle preferably includes a control portion allowing for control of the motor system. The handle may be a single unit, or more preferably bifurcated. A single motor can be used to drive the modular system via addition of a paired/mated second driven brush system (on a separable chassis) that is both fixed via the chassis, and the brushes are in rotational communication with one another via exposed interlocking gears, pulley/strap/chain/belt, or otherwise. The modular chassis can be used in single powered mode (one brush), or in dual mode (two brushes) with a power chassis in gear communication with the driven chassis.

The electric motor control system preferably includes an on/off switch protected by a safety interlock, and connective wiring to enable electrical communication between all on-board electrical components, as well as, a provision for receiving electrical power from an external source. An on-board AC solid-state relay (SSR) that utilizes a low voltage DC switching signal may be used to apply AC power to the electrical motor based on the position of the operator controlled On/Off switch. The low voltage DC power source for the SSR switching signal may be provided by an on-board battery (i.e. 9V) or preferably an on-board AC to DC converter that is in communication with both the On/Off switch and the SSR. Use of the DC switched SSR provides an opportunity to improve operator safety by moving the high voltage AC circuitry from the control handle to the motor assembly.

A quick-release brush lock, such as an anti-backing quick-release may be necessary for the modular combination of two brushes when coupled via gears. The quick release includes a wedge action clutch in conjunction with a spring biased lug plate that, during brush installation, is displaced by the lugs emanating from a motor (or transmission) system, whereby a quarter-turn of the brush assembly wedges the clutch onto the motor lugs, simultaneously the spring biased lug plate is allowed to return to its collapsed position thereby preventing unwanted disconnection of the wedge action clutch (brush assembly) from the motor lugs. Removal of the brush assembly is accomplished by manually extending and holding the spring biased lug plate followed by a quarter-turn of the brush assembly (opposite of installation direction).

BRIEF SUMMARY OF THE DRAWINGS

These and other features and advantages of the present disclosure will become more readily appreciated as a better understanding is derived through examination of the detailed description and accompanying drawings, wherein.

The various embodiments of the present apparatus will hereinafter be described in conjunction with the appended drawings, wherein like designations denote like items.

DETAILED DESCRIPTION OF THE DISCLOSURE

As discussed above, embodiments of the present disclosure relate to a rotary surface cleaner (hereinafter "cleaner") and more particularly to a cleaner that combines the direct cleaning action of a rotary brush and a highly maneuverable chassis into a single apparatus.

Generally speaking, the single brush embodiment of the cleaner comprises a highly maneuverable wheeled chassis, a rotary brush, a rotary power source, a handle, an adjustable and wear-compensating suspension system, as well as, assembly hardware.

Figure 1:
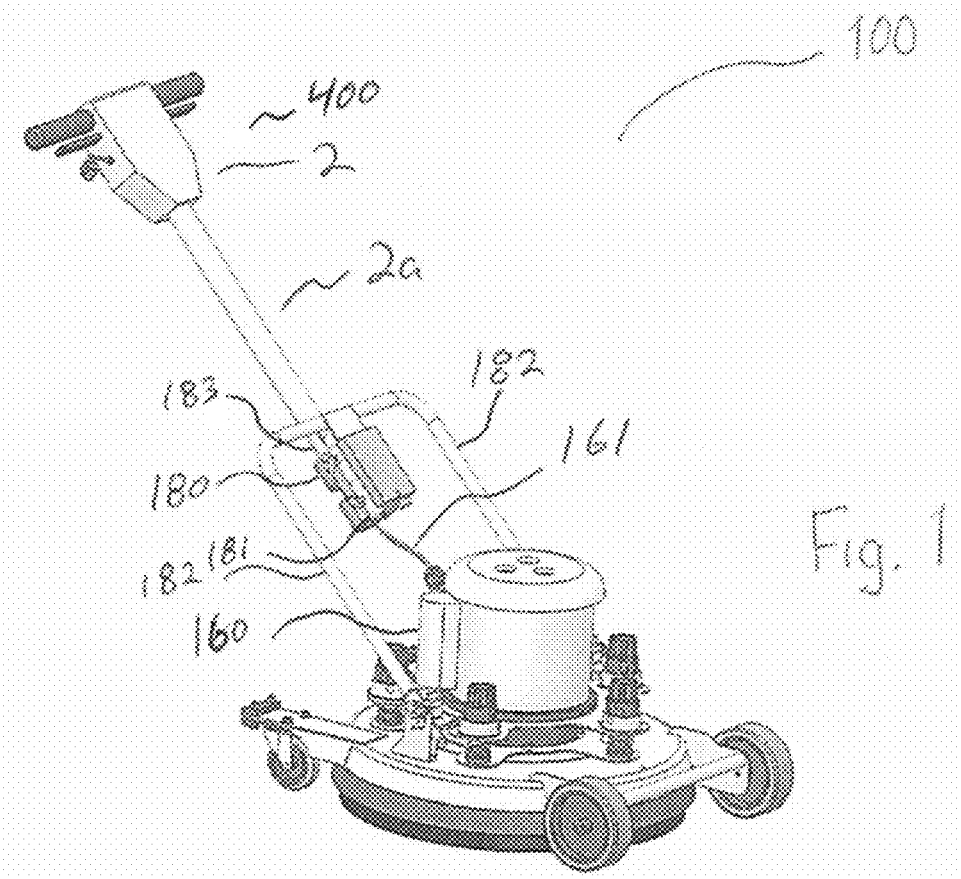
FIG. 1 is a front perspective view of an embodiment of the present invention.
Figure 1A:
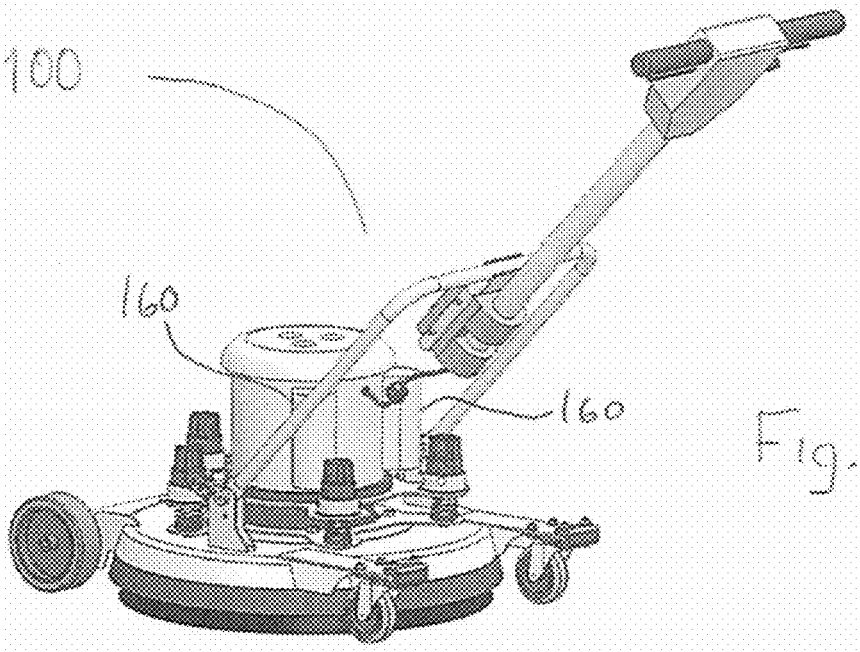
FIG. 1*a* is a rear perspective view of an embodiment of the present invention.
Figure 2:
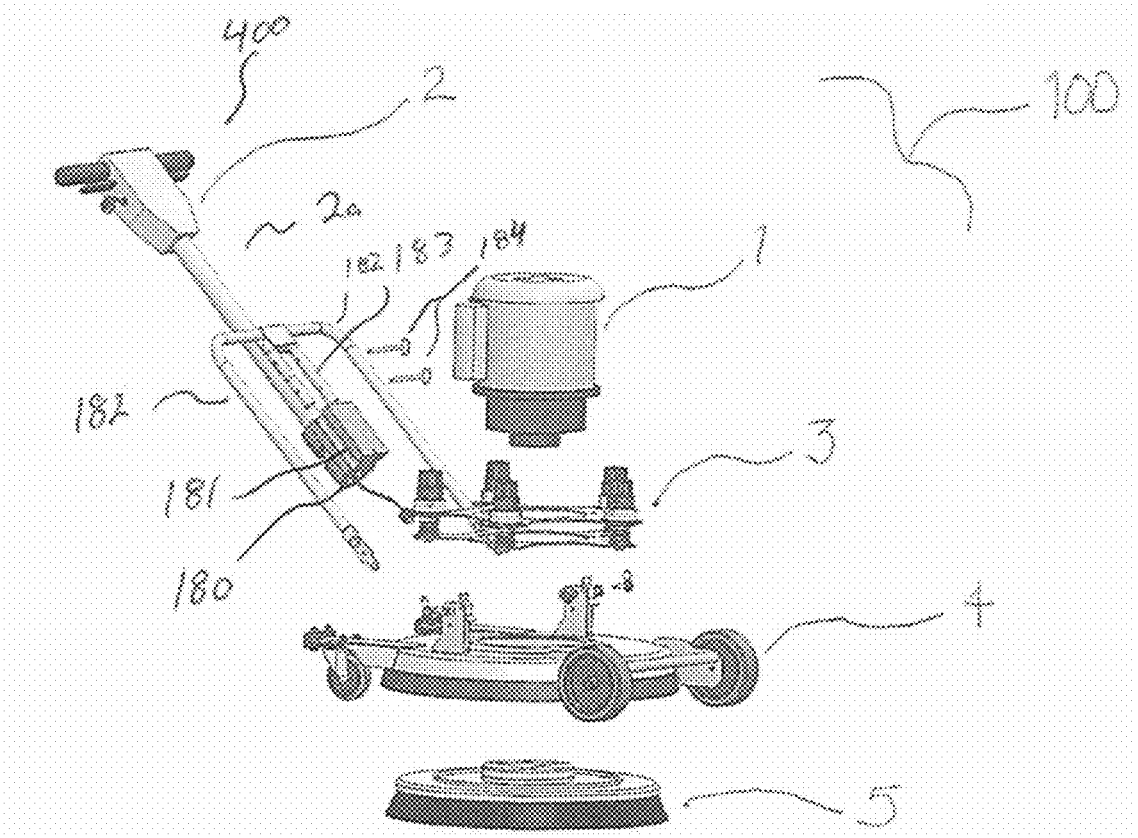
FIG. 2 is an exploded view of an embodiment of the present invention shown in FIG. 1.

Referring to the drawings by numerals of reference there is shown in FIG. 1, FIG. 1*a*, and FIG. 2, forward and aft angular perspective views, as well as exploded view for the single brush embodiment of cleaner 100 in the as-used position. Cleaner 100 includes rotary power source 1, removable handle assembly 2, adjustable and wear compensating suspension system 3 (hereinafter "suspension system"), wheeled chassis 4, and rotary brush assembly 5. Rotary power source may include an electric motor 1*a*, preferably using alternating current power, or other power source known in the art that suffices to fit on the cleaner and be useful for driving brushes. Upper handle 2*a* of handle assembly 2 may include mount interface 180 that includes channel recess 181 adapted to mate with handle assembly lower arm 182 or mounting handle bar. Upper handle 2*a* can be affixed to lower handle assembly via pins 184 through recesses in mounting handle bars 183.

Power source 1 may include transmission 1*b*, as is known in the art, such as a 10:1 system, or other useful system to accomplish the purposes of the invention. The rotary brushes are preferably run in the range of 100-250 RPM for most purposes, whereas a common appropriate motor used on t the art runs at approximately 1,700 RPM, therefor the transform is necessary. In certain engagement, such as high-speed burnishers, a higher brush RPM may be needed, whereby the transmission may be much lower, i.e. 2:1 or even in reverse (to allow faster brush speeds in excess of 1750 RPM, or other motor provided RPM). Motor may include capacitors (here two are shown) 160 to allow start-up of motor when triggering power source is inadequate to start motor. Signal may come from controller 400 via wire 161 to connect controller to motor.

Figure 3:
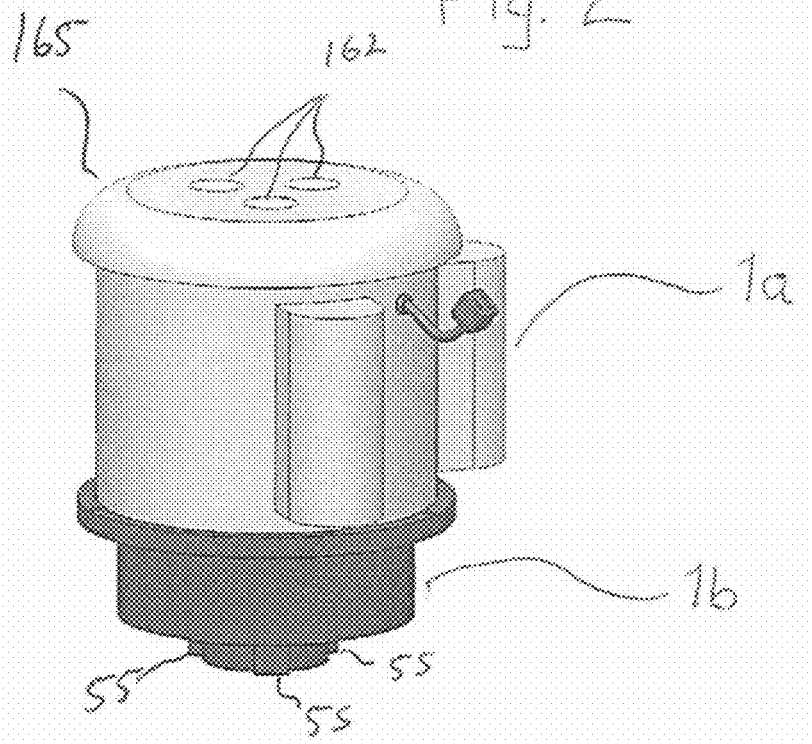
FIG. 3 is an isolated view of a motor from an embodiment of the present invention shown in FIG. 1.

Referring to FIG. 3, the rotary power source 1 is comprised of a motor 1*a*, typically a one hundred-twenty volt alternating current, and a planetary transmission 1*b* set up for a 10:1 reduced speed output. Alternating current may be used to power motor 1*a* supplied via electrical plug 104 in electronic communication with motor. The output of the planetary transmission 1*b* may incorporate a three-lug pattern with lugs 101 that are designed to engage with wedge-action clutch 102 that may be fastened to the upper surface of rotary brush 5 (shown in FIG. 2). Both rotary power source 1 and three-lug mount transmission design are preferably industry standard components routinely used in the janitorial profession for similar cleaners. Power source 1 preferably includes flange 105 to engage (and preferably rest upon) suspension system 3. Dome plate 165 fits over motor and provides ornamental as well as protection from the elements. Dome plate 165 over motor 1*a* provides no opening to allow drip/rain and otherwise shields the motor so as to allow for outdoor use. Depressions 162 allow for screws to affix dome plate to motor 1*a*. Transmission 1*b* may include lugs 55 (here shown for a tri-lug system) that can connect with the brush or otherwise into a clutch that allows motor to run brushes.

Figure 4:
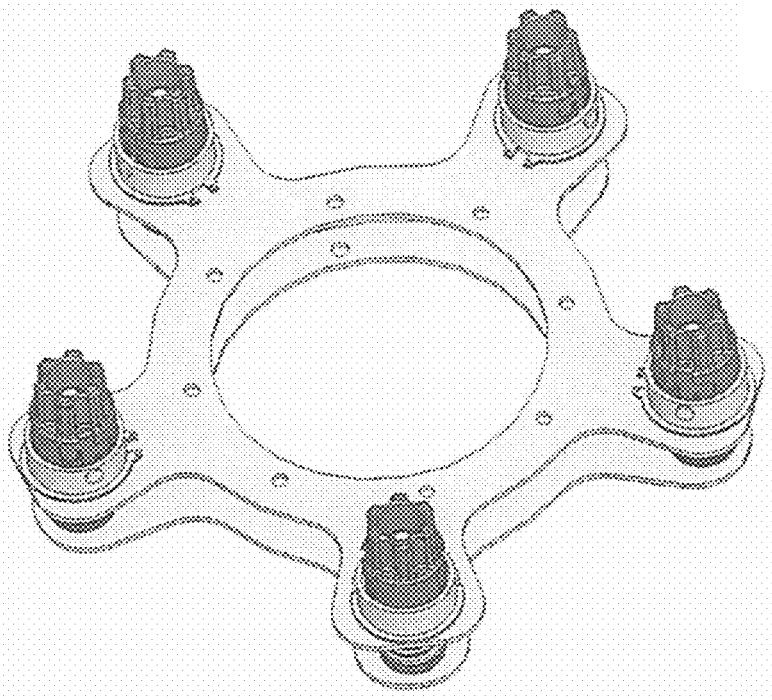
FIG. 4 is an angular perspective view of a suspension system of an embodiment of the present invention shown in FIG. 1.
Figure 4A:
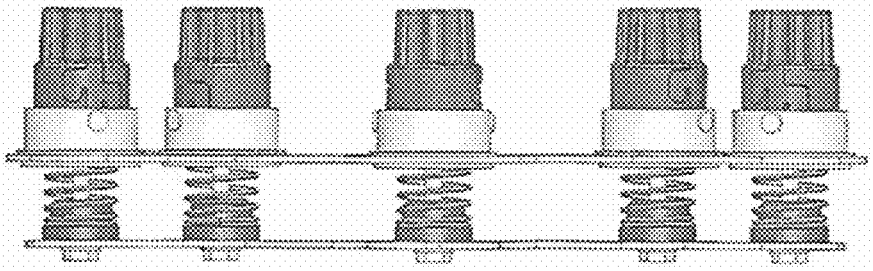
FIG. 4*a* is a side view of a suspension system of an embodiment of the present invention shown in FIG. 4.

In referring now to FIG. 4 and FIG. 4*a*, an angular and front perspective of the fully assembled suspension system 3 is shown. Suspension system 3 is preferably rigidly fastened to both cleaner chassis 4 via flange of the rotary power source 1 (not shown). This relationship is illustrated in FIGS. 1 and 1*a* of the single brush embodiment of the cleaner 100. Suspension system includes independent spring assemblies 130, preferably five, as shown in FIG. 4 evenly spaced around center plate ring 131 (with option apertures 132) to couple with power source 1. Spring assemblies are retained to center plate ring 131 via retaining rings 11.

Figure 5:
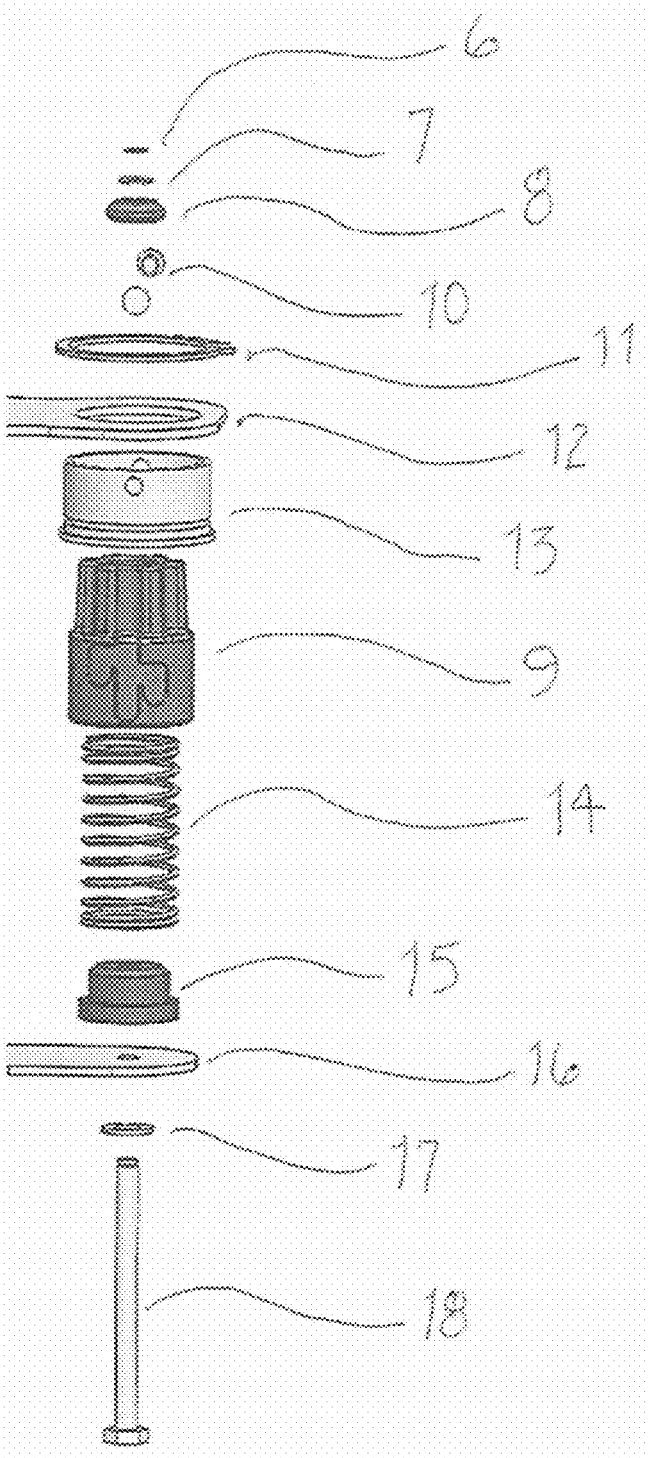
FIG. 5 is an exploded view of a suspension assembly of an embodiment of the present invention.

Referring now to FIG. 5 which shows a representative fragmentary view of the spring module construction of the spring assemblies 130 that is repeated at four additional locations all equidistant from the central axis 135 of the suspension system 3 with center plate ring 131. On assembly 130, guide pin 18 is passed through washer 17 and through the locating hole in the chassis adapter plate 16. The spring guide 15 is placed over the guide pin 18 as is the compression spring 14 and indexing spring cup 9. Guide pin 18 acts as a rotation limit to prevent the plate from moving independently of the brush. Guide pin 18 also forms a part of the suspension system supporting the weight of the motor (and/or weights on driven module). Separately, and repeated at four additional locations, the stop collar 13 is passed through the circumferentially located hole of the motor adapter plate 12 until the lower flange of the stop collar 13 comes to rest against the underside of motor adapter plate 12 along center plate ring 131 at this time the retaining ring groove of stop collar 13 is present just above the upper surface of the motor adapter plate 12 wherein retaining ring 11 is installed. Two diametrically opposed load pins 10 are pressed into the cross-drilled holes of stop collar 13 until the flange of the load pin 10 comes to rest against the stop collar 13.

The suspension assembly process is advanced when the assembled motor adapter plate, or flange, is lowered onto the assembled chassis adapter plate (or center plate ring 131) wherein the grooves of the indexing spring cups 9 are aligned with the load pins 10 and all guide pins 18 pass through their respective indexing spring cups 9 and the springs 14 can now be compressed. The suspension system assembly 130 is complete when the bumper 8 and washer 7 are placed onto the protruding end of each guide pin 18 and the retaining ring 6 is placed into the groove at the top of each guide pin 18.

Figure 6:
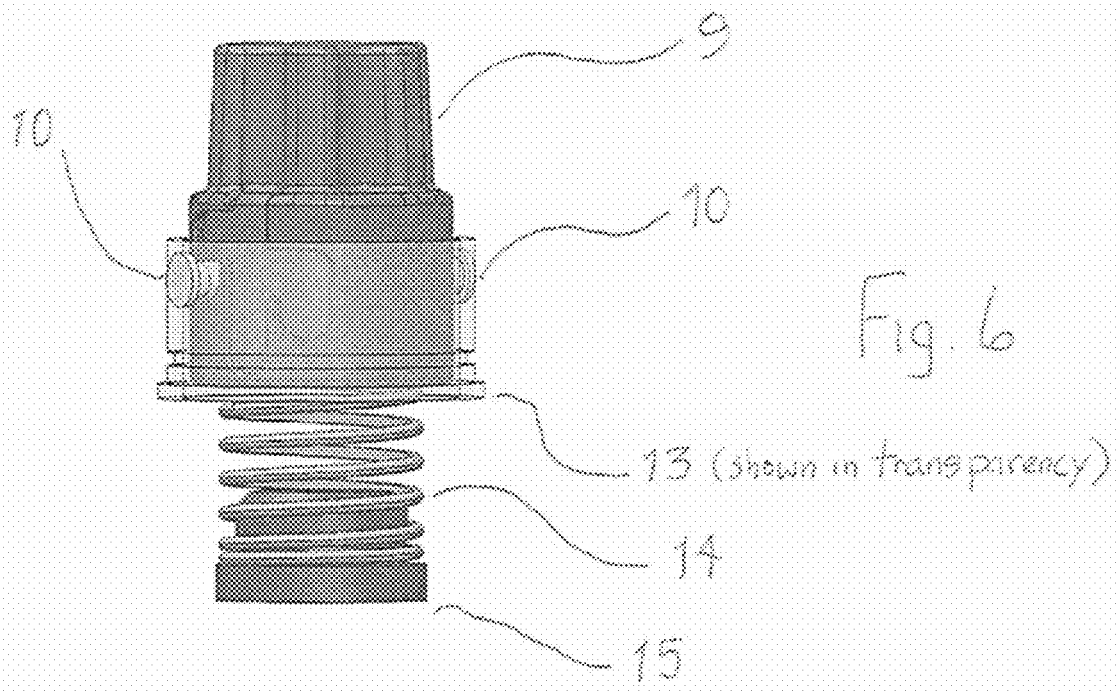
FIG. 6 is a partially see-through side view of a spring tension adjustment mechanism of the present invention.

In referring now to FIG. 6 which shows the relationship between the load pins 10, the stop collar 13 (which is shown as transparent for clarity), the indexing spring cup 9, and the compression springs 14 of spring assembly 130. FIG. 6 illustrates grooves 136 which are integral to both sides of each indexing spring cup 9. Grooves 136 terminate at different positions along the height of indexing spring cup 9 thereby establishing the elevations that correspond to a specific compressed height of each spring 14. As shown grooves 136*a*, 136*b* and 136*c* provide for varied height adjustments. At a particular setting, the force of the compressed spring 14 is applied to the indexing spring cup 9 whereby the groove of the indexing spring cup 9 is in contact with the load pins 10 thereby transferring the force of the compressed spring 14 to the motor adapter plate 12. In combination, the spring force of each module is applied to the flange of the rotary power source 1 thereby offsetting a portion of the power source weight and ultimately reducing the pressure of the brush against the surface being cleaned.

Figures 7A, 7B, 7C:
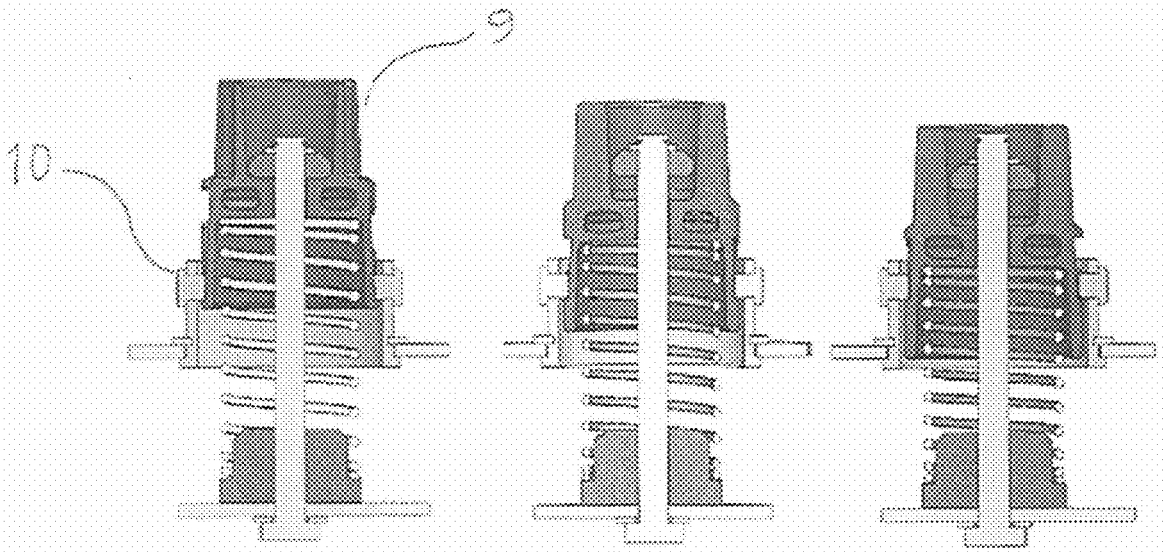
FIG. 7 (including FIGS. 7*a*, 7*b*, and 7*c*) demonstrates three various tension settings of the spring tension adjustment mechanism as shown in FIG. 6.

Referring now to FIG. 7 which illustrates the adjustability feature of the suspension system 3. FIG. 7*a* illustrates a setting that maximizes the brush down force whereby the termination wall of the central groove in the indexing spring cup 9 is in contact with the load pins 10 thereby establishing the tallest spring installed height and therefore the lowest installed spring force at groove 13*a*, resulting in the highest brush down force. In a similar fashion, FIGS. 7*b* and 7*c* illustrate settings which reduce the brush down force by increasing the compression of the spring 14 thereby offsetting a greater portion of the rotary power source 1 weight at grooves 136*b* and 136*c* respectively. Regardless of the setting, the installed height of the spring must keep a reserve of compressibility in order to account for bristle wear with respect to the solid height of the spring 14. This provides the wear-compensating feature of the suspension system 3. As a brush bristle wears, it becomes shorter and stiffer thereby requiring less down force to get satisfactory cleaning action. The worn bristles are shorter which allows the rotary power source 1 to move toward the ground, further compressing the springs 14 and thereby further reducing the down force on the bristles. Additionally, if the surface to be cleaned is rough, the indexing spring cups 9 can be positioned to provide the greatest amount of installed force from the springs 14 (FIG. 7*c*) thereby reducing the brush down force and corresponding counter force that is needed to oppose the torque generated by the bristles of the rotating brush interacting with the roughened surface.

Figure 8:
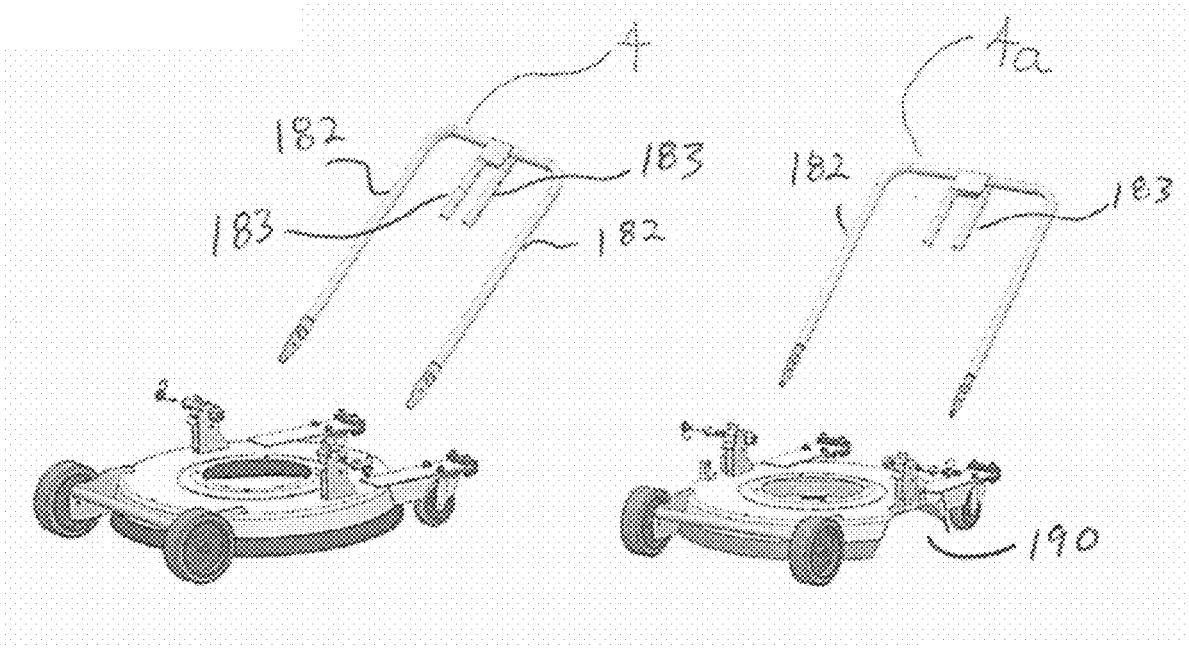
FIG. 8 is a partially fragmented view of a chassis assemblies used in two varied embodiments of the present invention.

In referring now to FIG. 8 which shows forward angular perspective views of the chassis assemblies utilized by the standard embodiment 4 and the exposed double brush embodiment 4*a*. As shown, the chassis 4 of the cleaner 100 is comprised of a deck structure 120 that surrounds the rotary brush assembly 5 to which mounting provisions for the forward wheels 121, rear casters 122, and rotatable handle 125 are rigidly attached. Both forward and aft wheel structures 123 and 124, respectively, are attached to deck 120 in order to create a fixed height, horizontally level and stable platform. Rear caster wheels 122 are free to completely rotate providing a high degree of maneuverability. Handle mounts 126 for each chassis incorporate positive stop features to limit the angular range of handle travel. Deck 120*a* of the exposed double brush chassis 4*a* is modified to provide a flush mating surface and allow the geared brushes of adjacent units to mesh. Both standard chassis 4 and driven chassis 4*a* include a cut out 190 in the side to allow for interlocking of the brushes via gears, etc. to allow power driven brush rotation to drive driven brush in un-powered module—for dual brush mounts. Handle assembly will then be modified to allow upper handle (not shown) to affix to the center of the dual brush module via outside handle bars 182 rather than the single central mounting handle bars 183.

Figure 9:
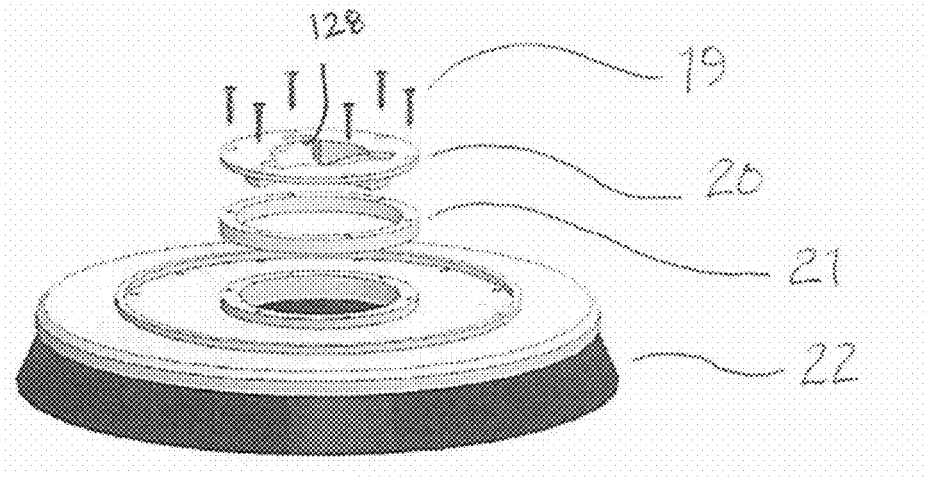
FIG. 9 is an exploded view of a rotary brush assembly of an embodiment of the present invention.

Referring now to FIG. 9 which shows an exploded view of a rotary brush assembly 5 wherein the fasteners 19 are used to rigidly attach the wedge-action clutch 20 (with lug recesses 128 to accommodate the power source transmission from motor) and the hub spacer 21 to a commercially available rotary brush 22. The hub spacer 21 is used to provide clearance between the top of the rotary brush assembly 22 and the underside of the chassis 4 or exposed chassis 4*a*, as well as, adequate working height for the spring based suspension system 3. Motor transmission is mounted onto clutch 20 via a quarter-turn to lock in place. Further rotation along with motor only reinforces the clutch lock, however, reverse rotation of brush will release clutch from motor transmission.

Figure 10:
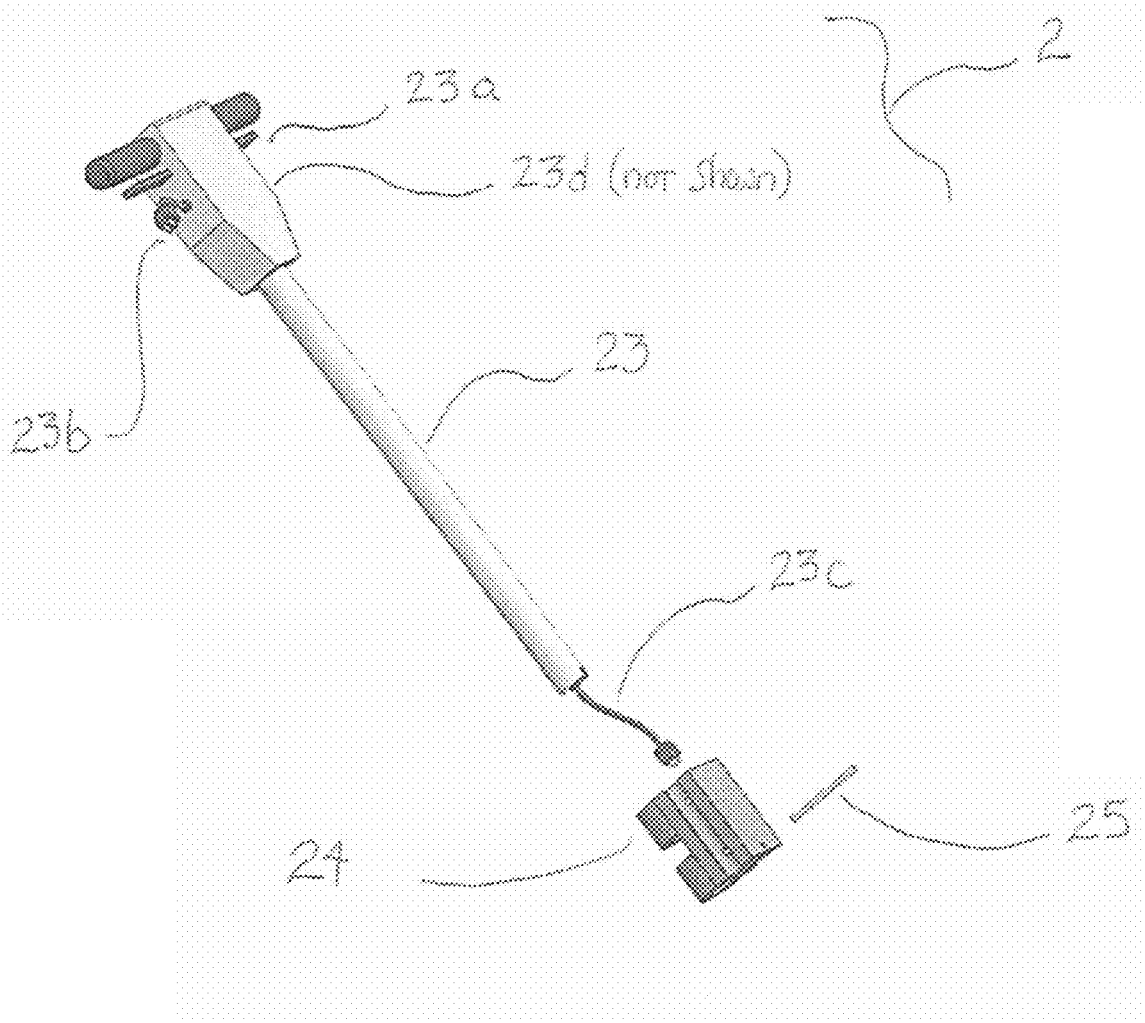
FIG. 10 is a fragmentary view a handle assembly of an embodiment of the present invention.

In referring now to FIG. 10 showing an angular perspective view of the removable handle assembly 2 comprising control head 23 the control head mounting adapter 24 and the anti-rotation stop pin 25. Control head 23 is made from the handles found on commercial rotary floor maintenance equipment thereby retaining the left and right motor control levers 23*a* the incoming power cord 23*b* the motor power cord 23*c* and the safety lock-out 23*d* which prevents inadvertent energizing of the motor when the user in not in control of the machine. In the single brush embodiment, the control head mounting adapter 24 mates with the provisions found on the chassis 4 of the cleaner 100 as illustrated in FIG. 1 and FIG. 1*a*. Incoming power cord 23*b* is eliminated in most embodiments of the improved electrical system (as shown and described relative to FIGS. 22-27) where power is supplied through motor system to control 400.

Figure 11:
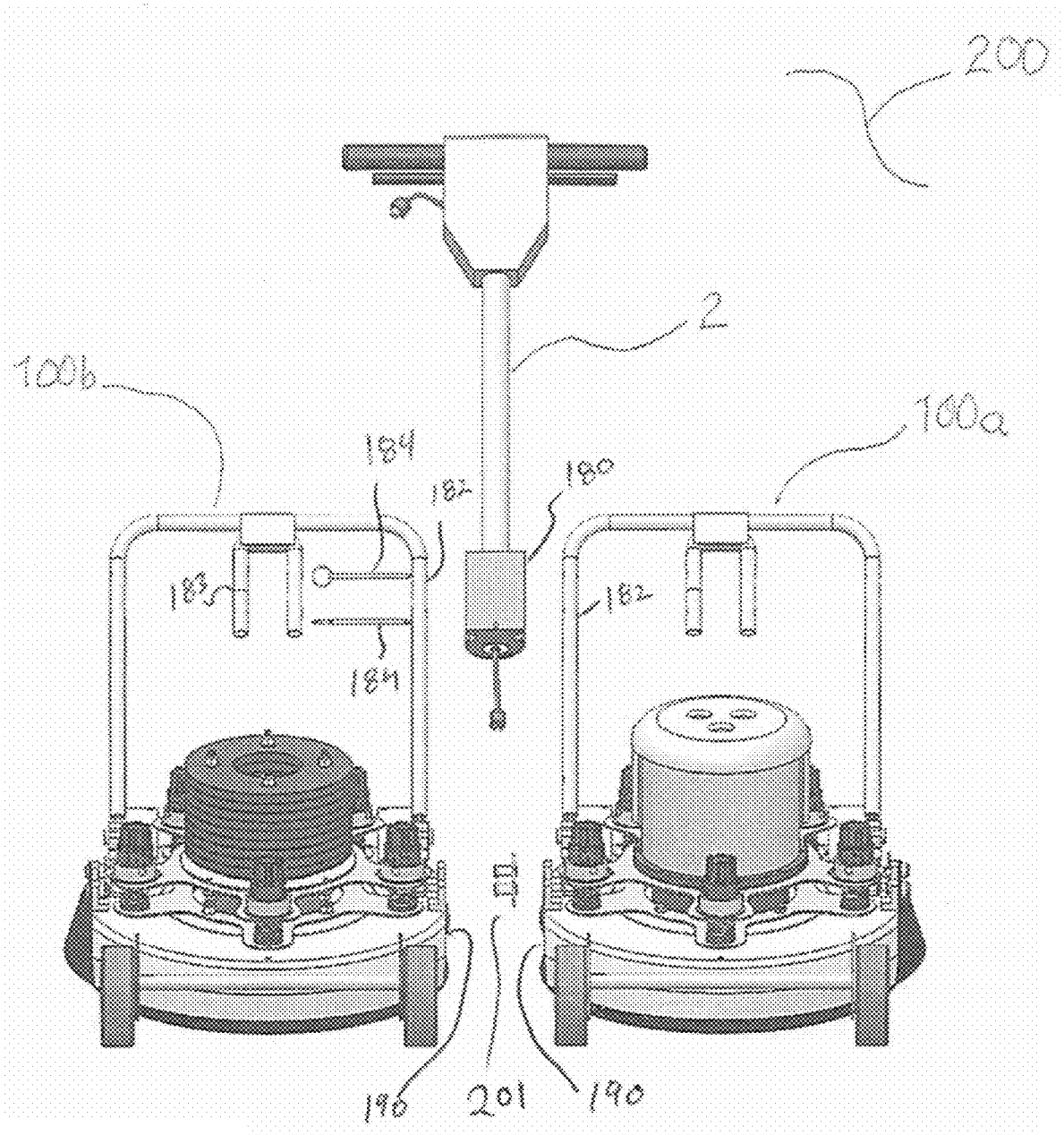
FIG. 11 is a partially fragmented view of a dual brush embodiment useful with a single handle of the present invention.

Referring now to FIG. 11 which shows a partial fragmentary perspective view of the double brush cleaner 200 comprising the alternative powered chassis module 100*a*, driven chassis module 100*b*, the removable handle assembly 2, and miscellaneous attaching hardware. The double brush cleaner 200 can be used to increase surface cleaned simultaneously and reduce the time to clean large areas of soiled concrete or other hard surfaces. A single rotary power source 1 is used to rotate the brushes 5 and 5*a* of both the powered chassis module 100*a* and the driven chassis module 100*b*. Power source 1 remains on powered module and powers brushes in driven module. Couplers 201 are used to couple power chassis 100*a* with driven chassis module 100*b*. In some instances, couplers 201 may transfer electrical power to a motor on driven assembly (not shown) and thereby drive the rotation of brush 5*b*. Preferably, once coupled, exposed gear 26*a* may be useful to drive driven chassis brush via rotational motion of powered brush 5*a*. Brush gears may be exposed via cut outs 190 to allow driving of brush head. Upper handle interface 180 mates to handle bars 182 via pins 184 to affix both chassis into a dual brush mode.

Figure 12:
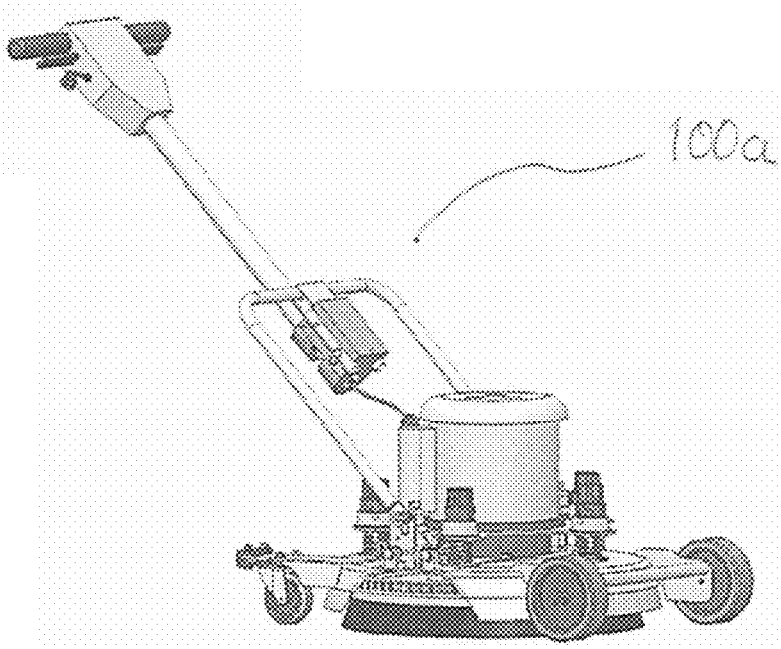
FIG. 12 is a right perspective view of an embodiment of the present invention.
Figure 14:
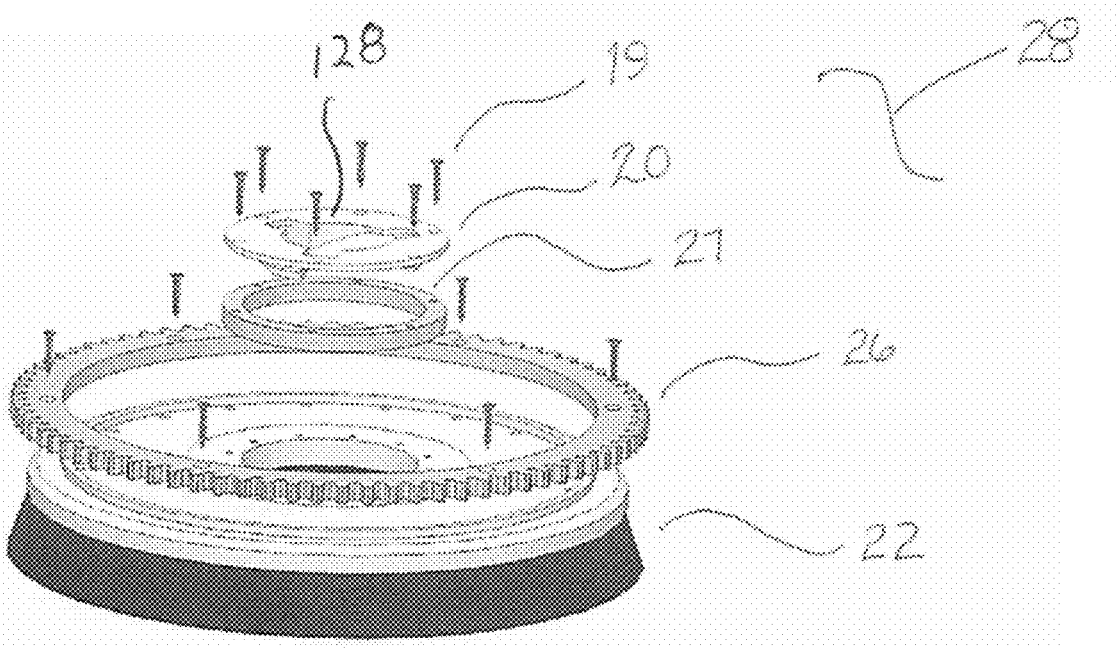
FIG. 14 is an exploded view of a rotary brush assembly of an embodiment of the present invention.

In referring now to FIG. 12 which shows a forward perspective view of the powered chassis module 100*a* which is a variant of the cleaner 100 in that exposed chassis 4*a* is used in lieu of chassis 4 and utilizing a geared rotary brush assembly 28 which is shown and identified in the discussion of FIG. 14.

Figure 13:
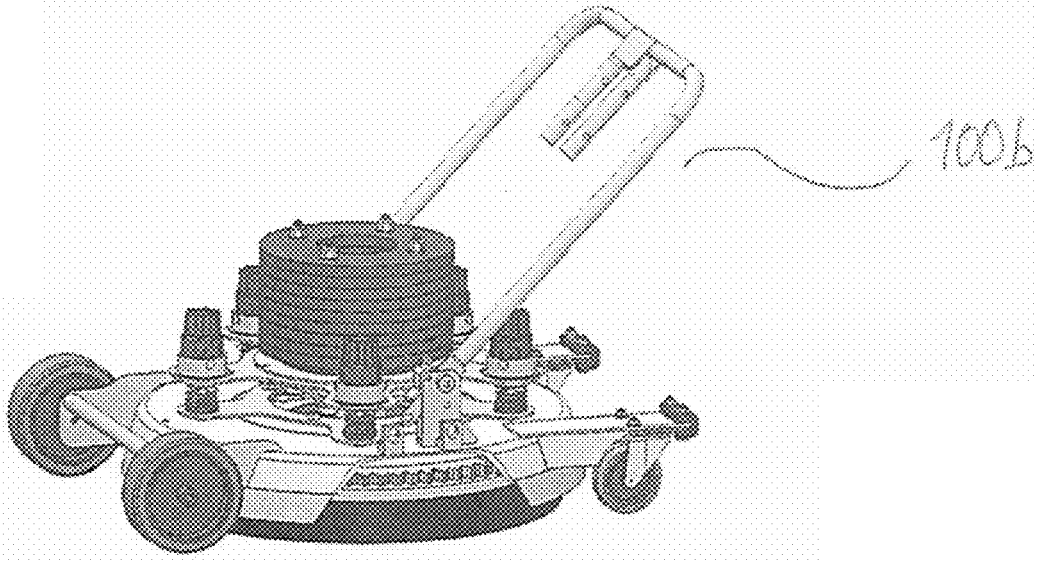
FIG. 13 is a left perspective view of an embodiment of the present invention.
Figure 15:
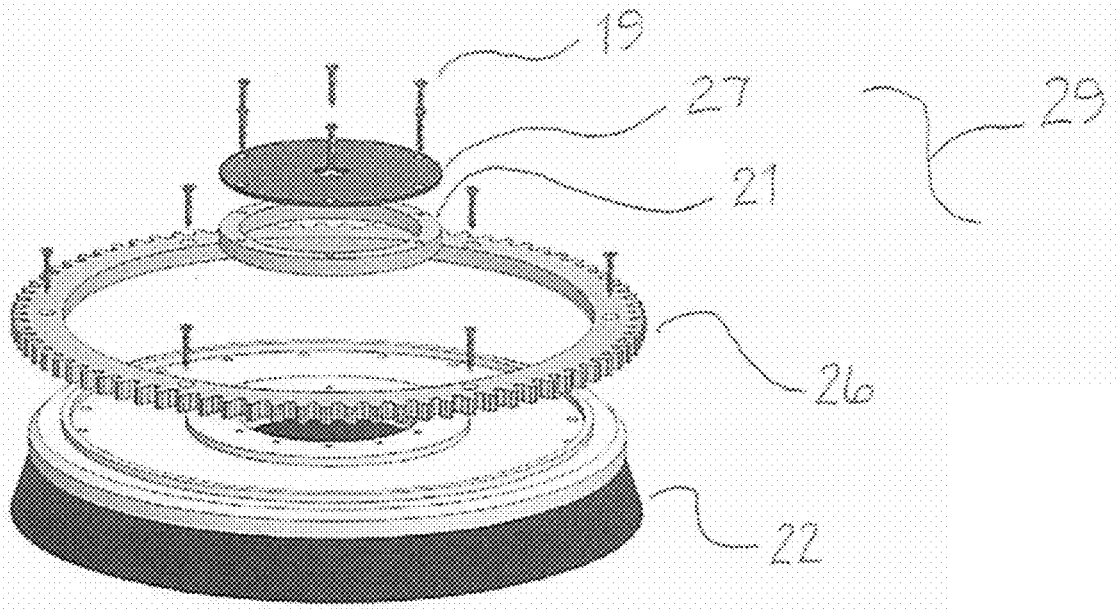
FIG. 15 is a fragmentary view of a rotary brush assembly of an embodiment of the present invention.
Figure 16:
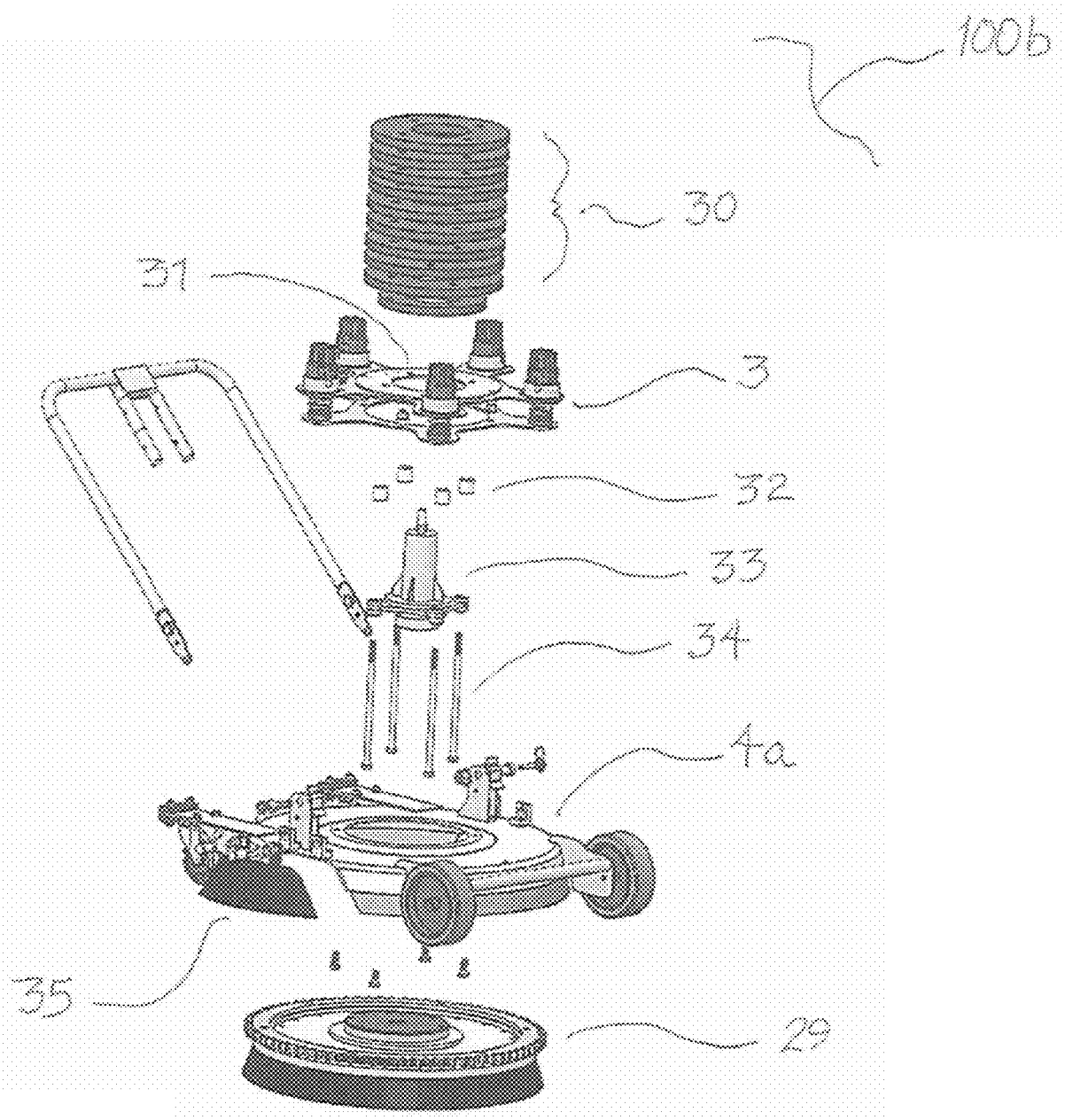
FIG. 16 is an exploded view of an embodiment of the present invention.

In referring now to FIG. 13 which shows a side perspective view of the driven chassis module 100*b* which is a variant of the cleaner 100 in that exposed chassis 4*a* is used in lieu of chassis 4, a geared rotary brush assembly 29 which is shown and disclosed with FIG. 15, and a weight stack 30 identified in FIG. 16 that provides the down force for the geared rotary brush assembly 29 in lieu of the rotary power source 1.

Referring now to FIG. 14 which shows a fragmentary perspective view of a geared rotary brush assembly 28 which is installed on the powered chassis module 100*a* within the double brush cleaner embodiment 200. The geared brush assembly 28 is comprised of fasteners 19 which rigidly connect the wedge-action clutch 20 and hub spacer 21 to the commercial rotary brush 22. Additionally, fasteners 19 are also used to rigidly attach ring gear 26 to the solid backing of rotary brush 22. As in commercial floor maintenance equipment the geared brush assembly 28 will mount to the three-lug provision of planetary transmission 1*a* of the rotary power source 1 via the wedge-action clutch 20.

In referring now to FIG. 15 showing a fragmentary perspective view of the driven rotary brush assembly 29 which is installed on the driven chassis module 100*b* of the double brush cleaner embodiment 200. The driven rotary brush assembly 29 is comprised of fasteners 19 which rigidly affix the spindle adapter plate 27 and the hub spacer 21 to the commercial rotary brush 22. Additionally, fasteners 19 are also used to rigidly attach ring gear 26 to the solid backing of rotary brush 22.

Referring now to FIG. 16 which shows a fragmentary view of the driven chassis module 100*b* used as part of the double brush cleaner 200. The driven chassis module 100*b* is comprised of chassis assembly 4*a* the suspension system 3 the weight stack 30 the weight stack adapter plate 31 that is used to mount the weight stack 30 to the suspension system 3. Additionally, spacer 32 is used to insure that the suspension system 3 of both the powered chassis module 100*a* and the driven chassis module 100*b* are resting at or near the same position once the respective brush assemblies are installed. Continuing, bolts 34 are used to rigidly connect spacer 32 and spindle 33 to weight stack 30 and suspension system 3. Spindle 33, commonly used in multi-blade lawn mowers, is a free-spinning mount for the driven rotary brush assembly 29 that incorporates spindle adapter plate 27 which enables the driven rotary brush assembly 29 to mount similarly to a lawn mower blade as is known in the art. Finally, guard assembly 35 is affixed to chassis 4*a* to prevent inadvertent contact with the exposed rotating brush and gear.

Figure 17:
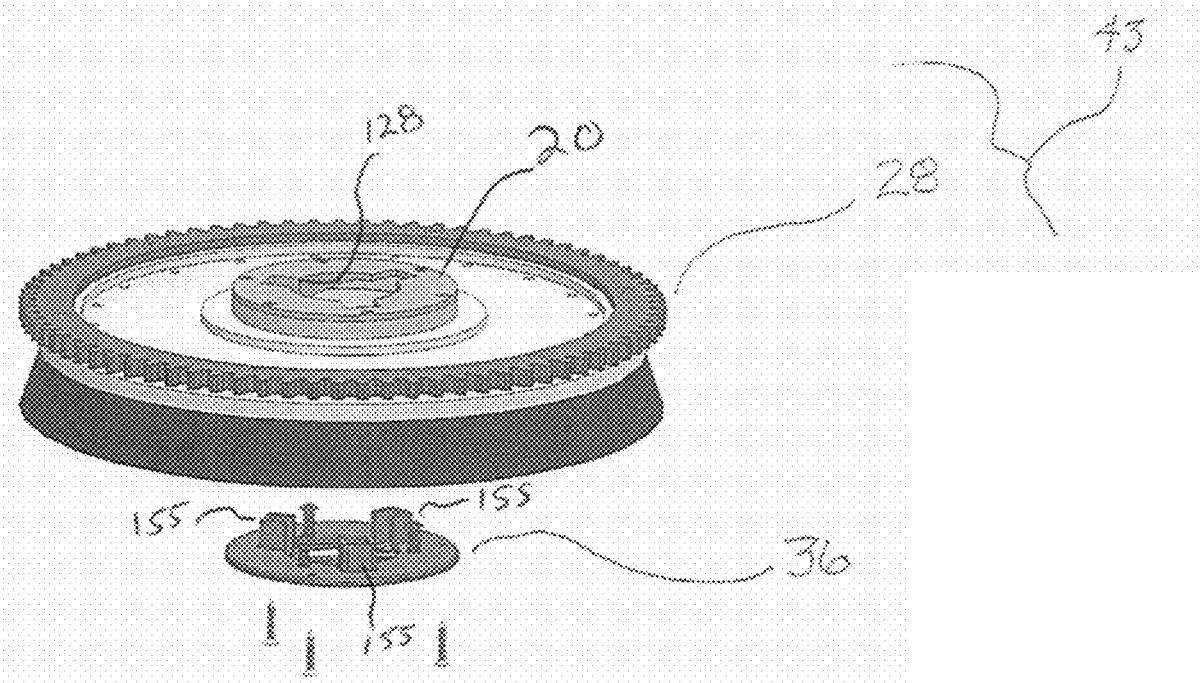
FIG. 17 is a fragmentary view of a geared brush assembly of an embodiment of the present invention.
Figure 20:
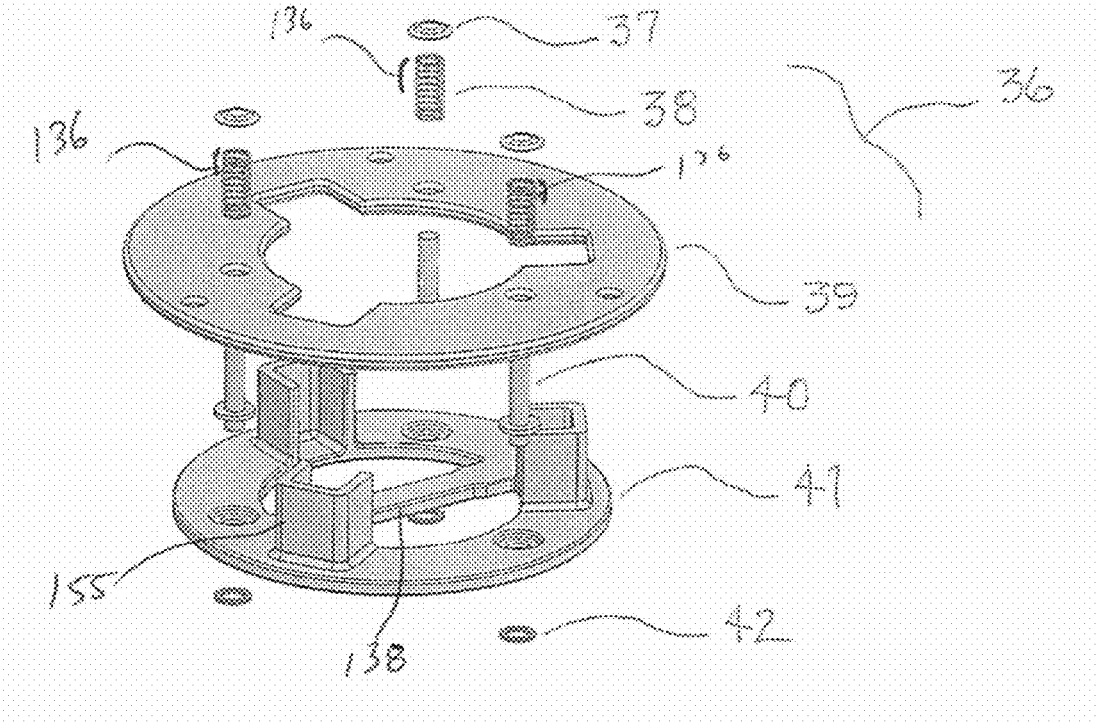
FIG. 20 is an exploded view of a quick-release device of an embodiment of the present invention.
Figure 21:
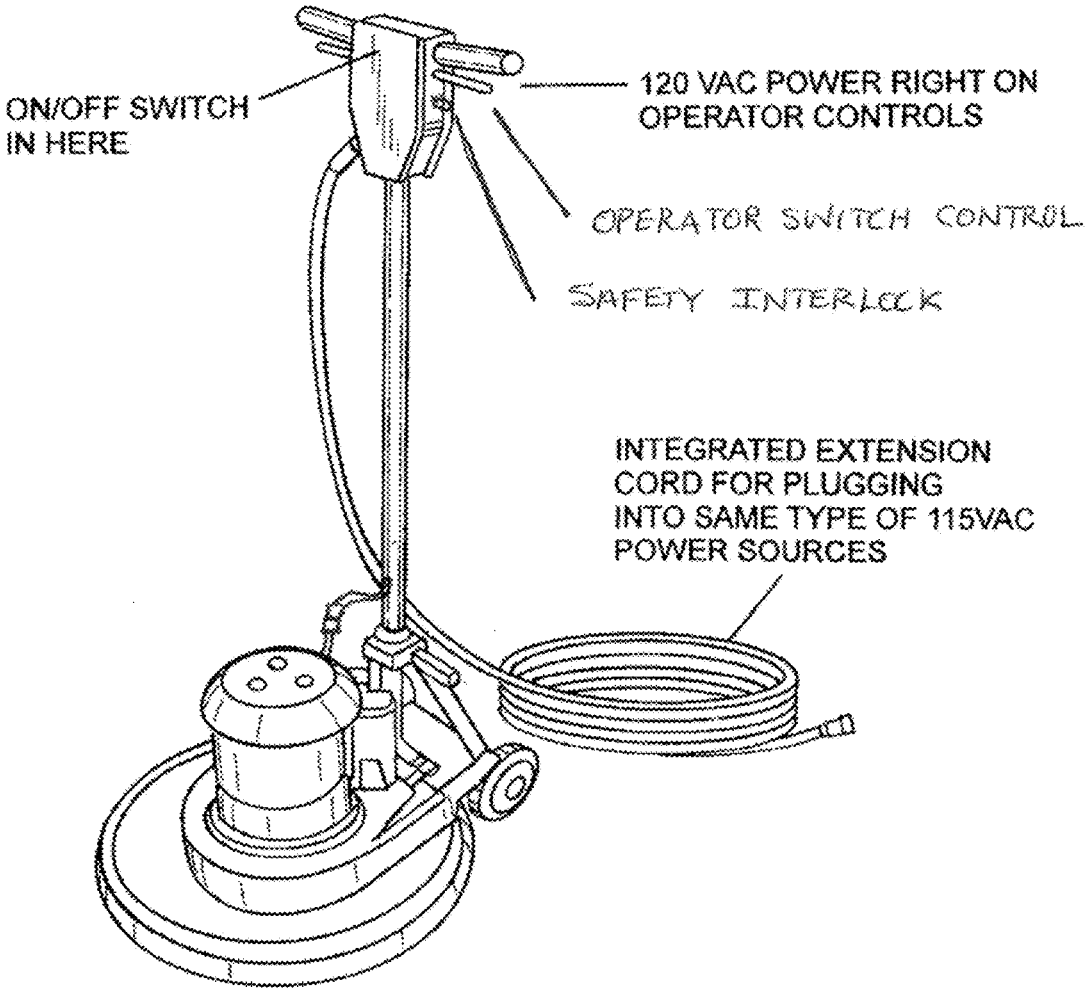
FIG. 21 demonstrates a perspective view of an embodiment of the prior art.
Figure 22:
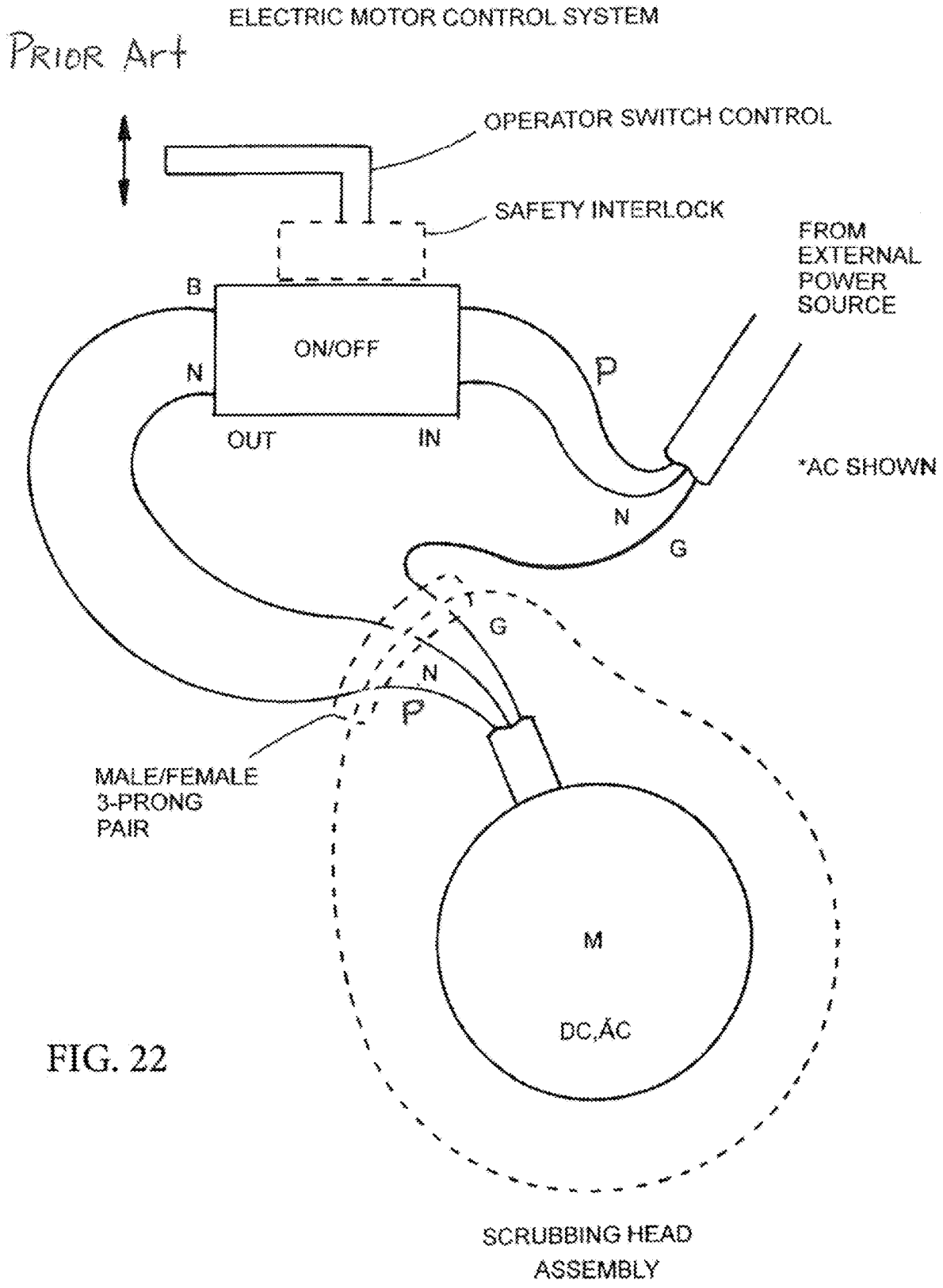
FIG. 22 demonstrates an electrical schematic of an embodiment of the present invention.
Figure 23:
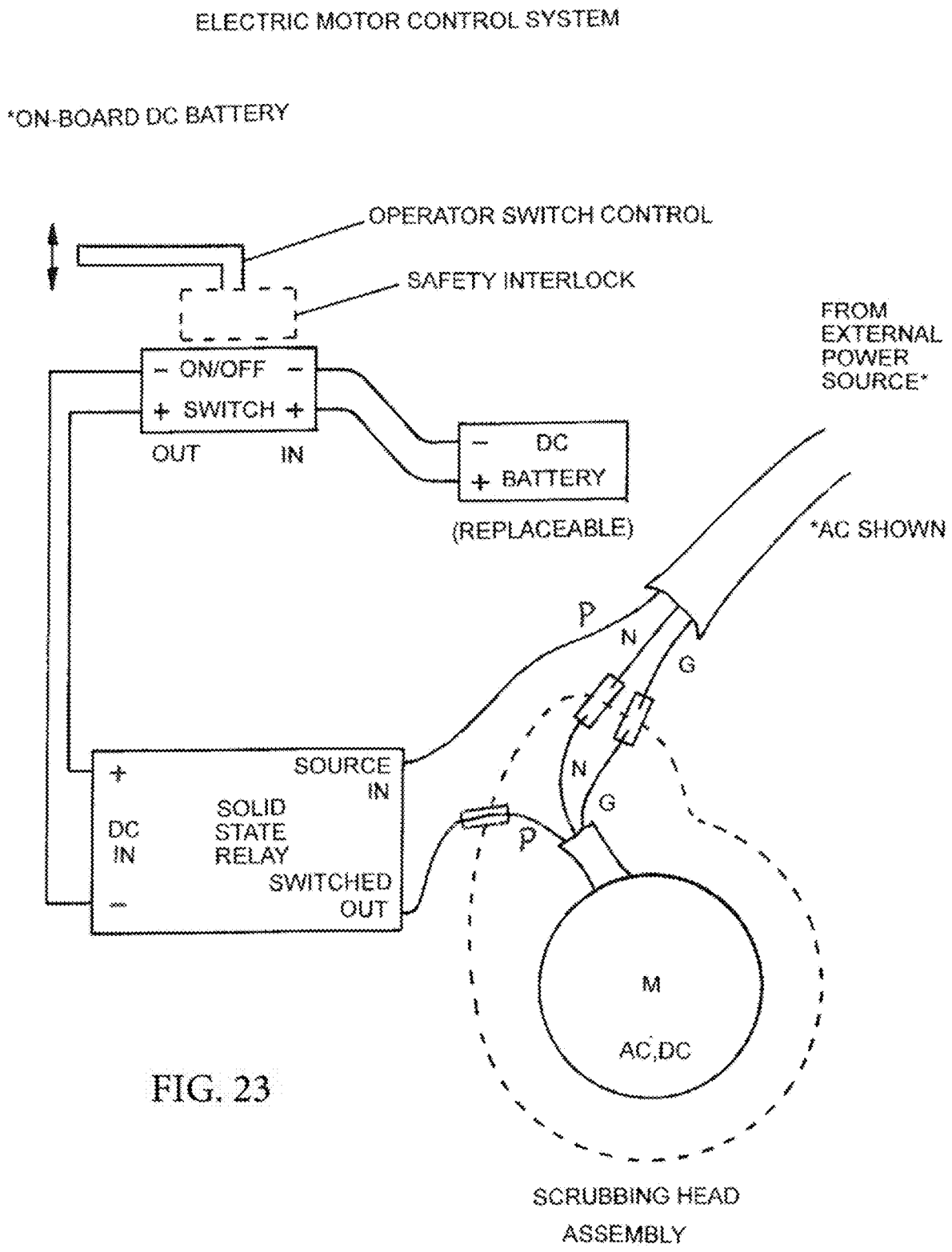
FIG. 23 demonstrates an electrical schematic of an embodiment of the present invention.
Figure 24:
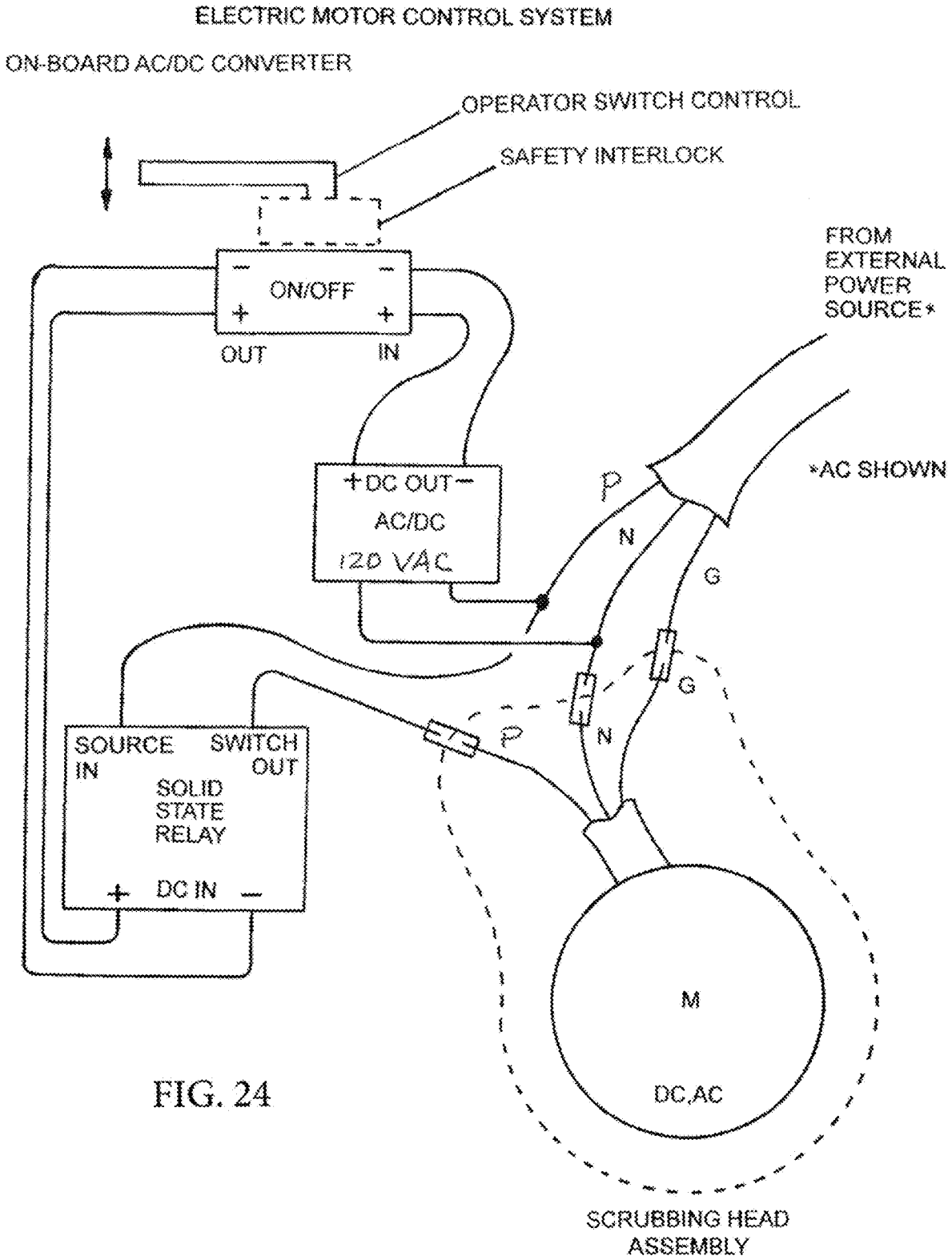
FIG. 24 demonstrates an electrical schematic of an embodiment of the present invention.
Figure 25:
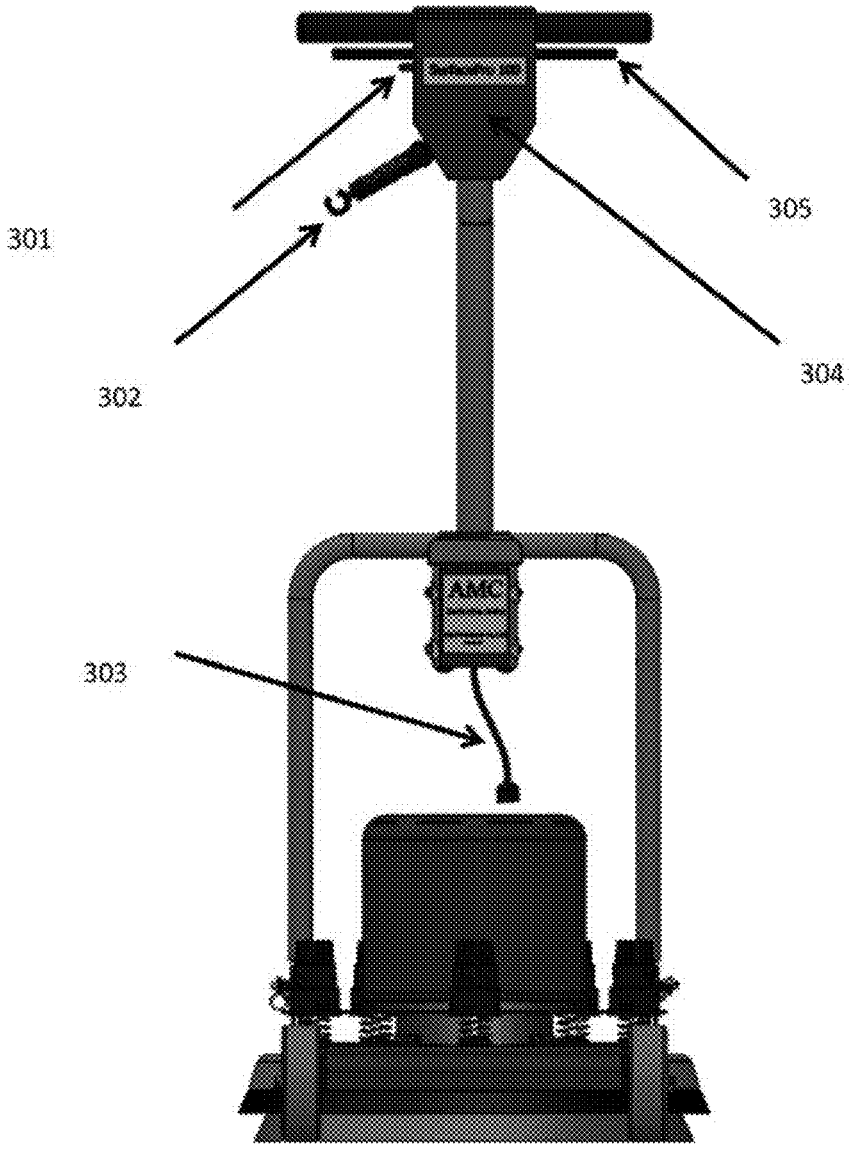
FIG. 25 demonstrates a front view of an embodiment of the present invention.
Figure 26:
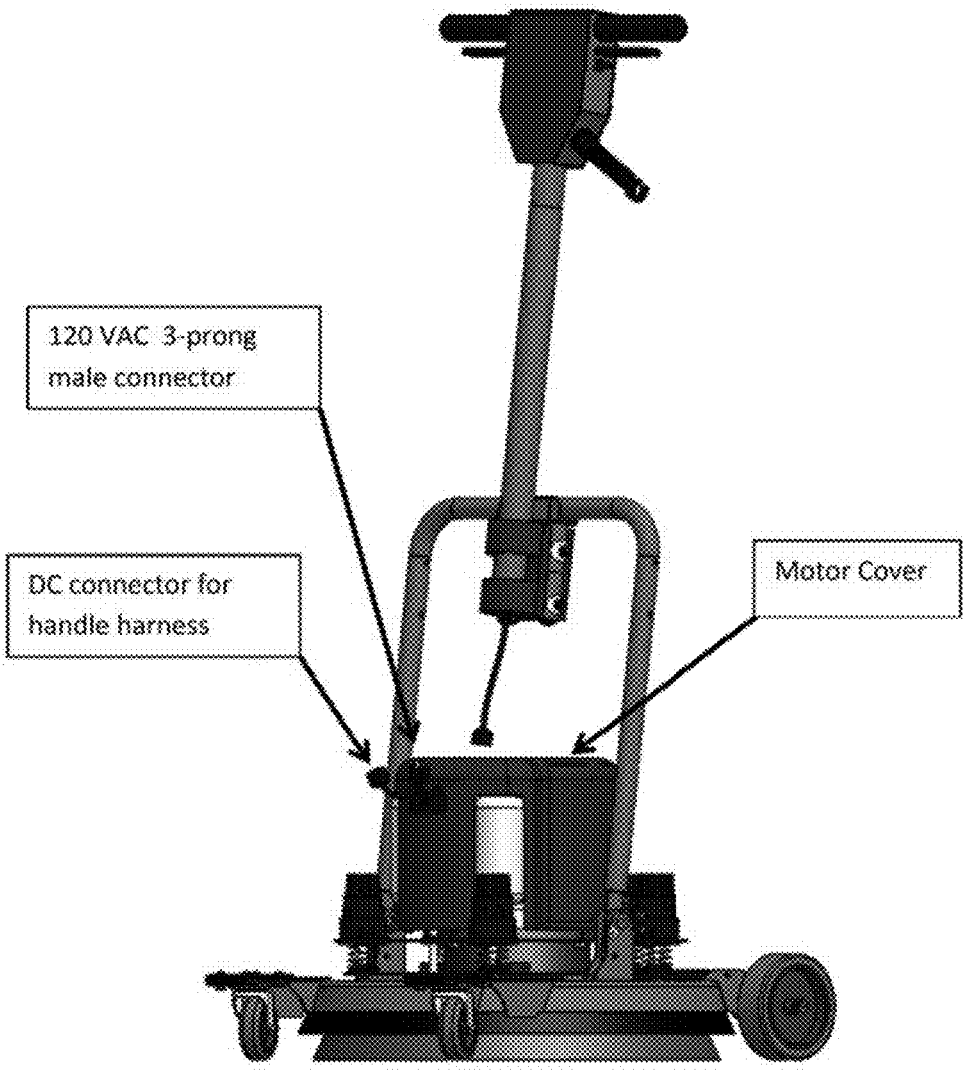
FIG. 26 illustrates a perspective view of an embodiment of the present invention.
Figure 27:
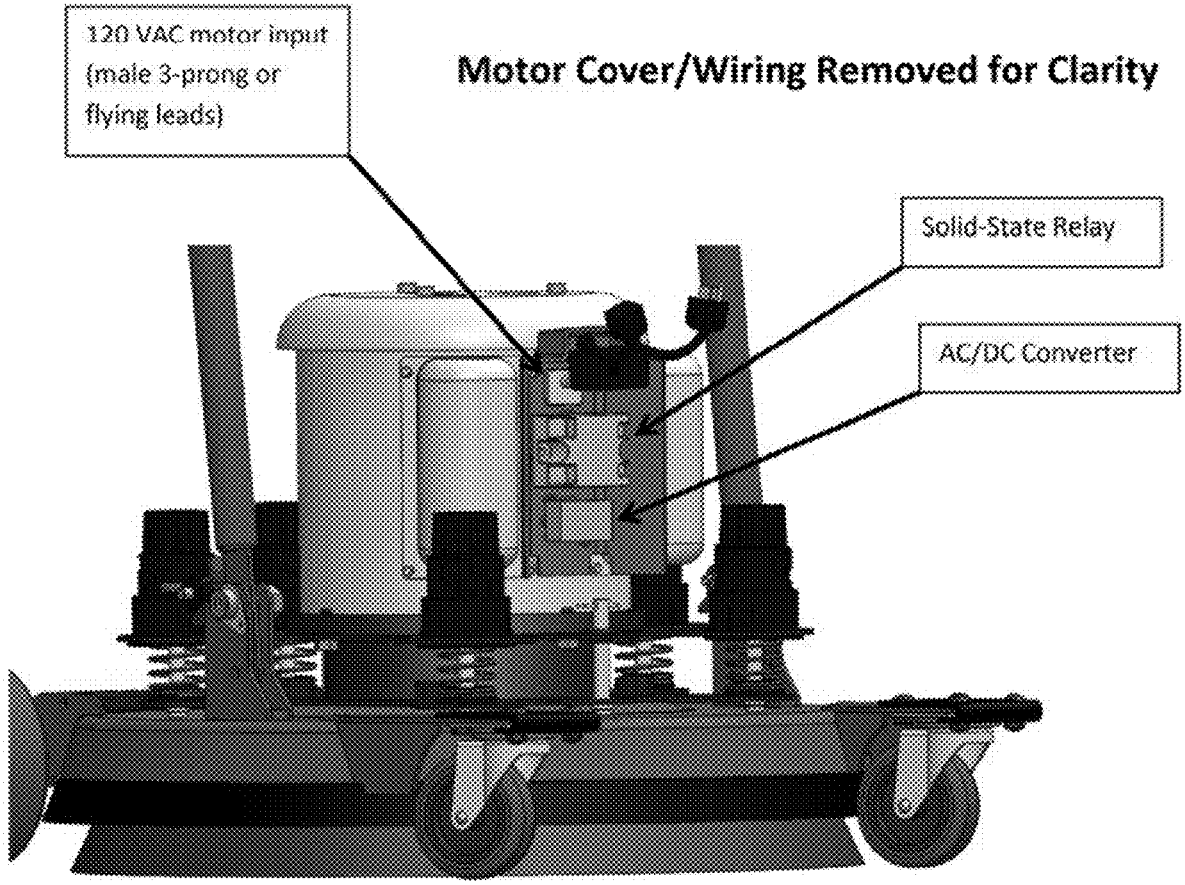
FIG. 27 demonstrates a close-up view of the motor and suspension system of an embodiment of the present invention.

In referring now to FIG. 17 which shows a fragmented perspective view of a geared brush assembly 43 that comprises the powered brush assembly 28 and an anti-backing quick-release device 36 which is disclosed in the discussion of FIG. 20. When three-lugs from power driver motor are mounted onto the brush assembly, clutch receives (three) receive lugs 55 (not shown) into lug receivers 128 in clutch 20. A one-quarter turn is used to mount and mate lugs with receivers to lock motor driver in place onto brush assembly. In the double brush application the driven brush assembly 29 rotates in the opposite clock direction to the powered brush assembly 28. When the motor control levers 23*a* are released, the electrical power to the rotary power source 1 is discontinued thereby making it possible for the rotational inertia of the driven brush assembly 29 to de-clutch the powered brush assembly 28 from the three-lug output of the rotary power source 1. The freely rotating driven brush (when not indirectly driven by powered motor) can continue on inertia and/or recoil causing the one-quarter turn clutch to disengage. Therefore, the quick-release anti-backing device is needed to dispose anti-backing device up into clutch and prevent disengagement of wedge clutch. When clutch is engaged, anti-backing lug bosses 155 are pressed downward, thus extending springs 136 and pushing anti-backing down to allow lugs to engage clutch. Upon one-quarter turn, springs 136 press bosses back up to capture or confine lugs in place. This prevents the lug from counter-rotating and disengaging the clutch when the brush may be spun from a force other than the motor.

Figure 18:
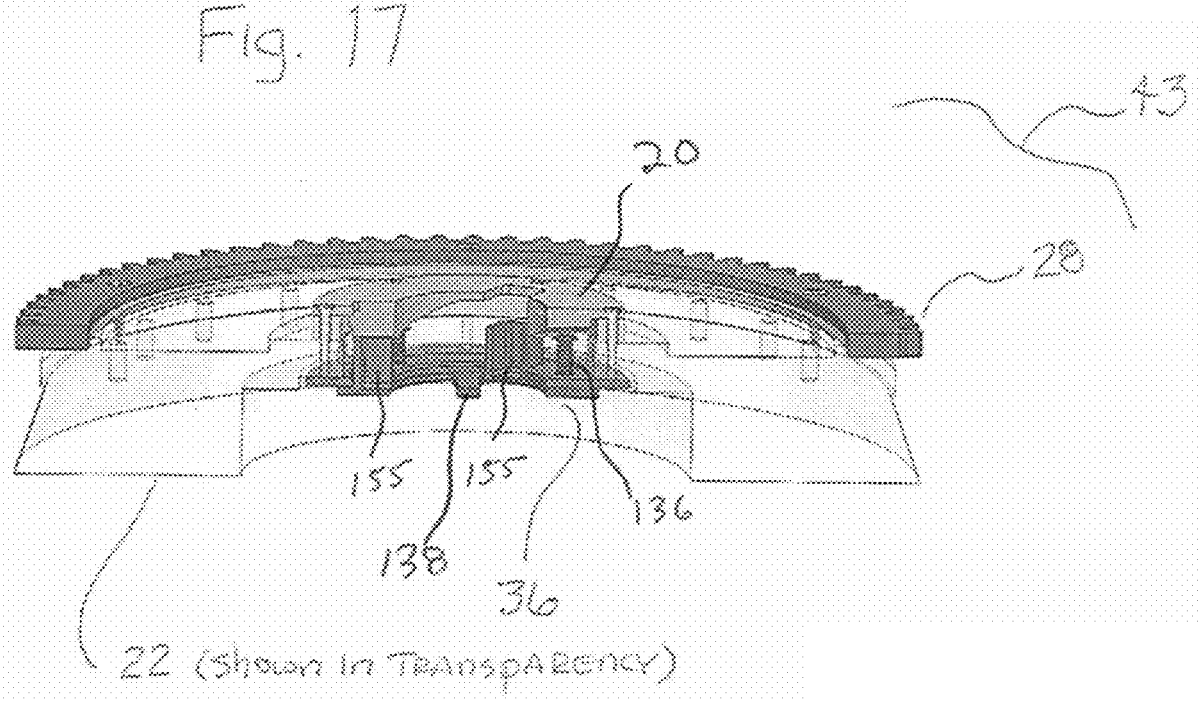
FIG. 18 is a cross-sectional view of a geared brush assembly incorporating the anti-backing quick-release device as shown in FIG. 17.

Referring now to FIG. 18 showing a cross-section view of geared brush assembly 43 illustrating an installed anti-backing quick-release device 36 into the powered brush assembly 28 via clutch 20. Without the use of the anti-backing device, when a smooth surface s used to join the double-brush, inertia in the driven brush can cause the powered brush side to turn and thus disengage the wedge clutch. Vertical spring 136 disposes anti-backing device to compress (vertically) and push the plate 137 into wedge clutch to maintain pressure therein. When replacement or removal of a brush head is required, center cross-bar 138 can be used to (pull) extend the anti-backing device (extending springs 136) and allow/provide a rotation to release anti-backing device to allow brush removal via clutch disengagement. Bosses 155 will then align with lugs (to push) allow for removal. As opposed to the open bosses 155 as shown, bosses may be solid, otherwise they may be shaped to better interface with lugs.

Figure 19:
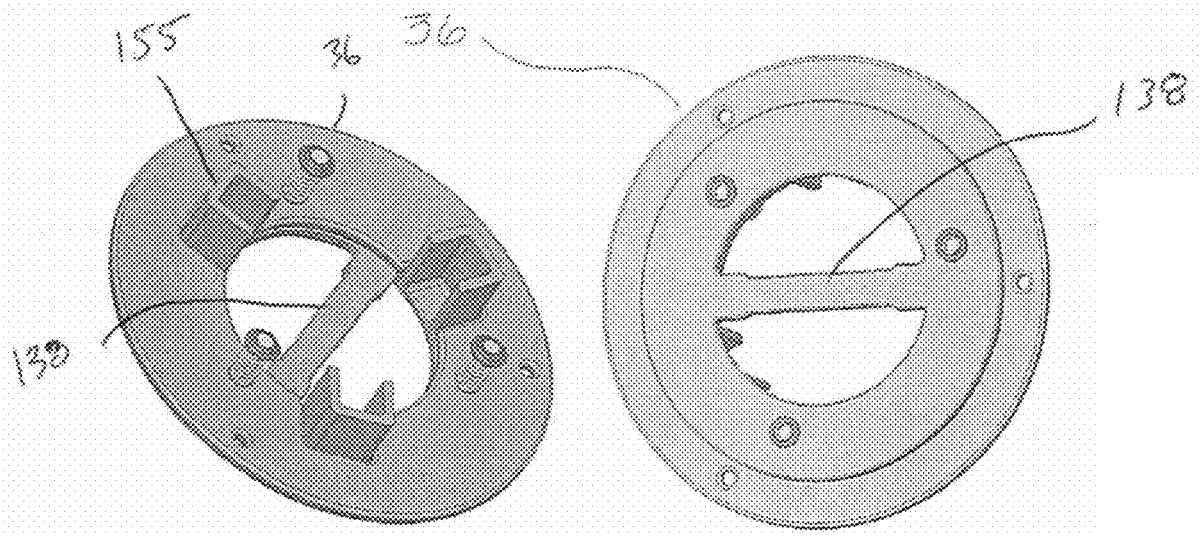
FIG. 19 shows a top and a bottom perspective view of an assembled anti-backing quick-release device of an embodiment of the present invention.

In referring now to FIG. 19 showing two angular perspective views of the assembled anti-backing device 36.

Referring now to FIG. 20 showing a fragmentary perspective view of the anti-backing quick-release device 36. Spring retainer 37 is used to establish and retain an installed force in springs 38 which are located around spring guide 40. With washer 42, the deformable end of the spring guide 40 is then used to rigidly join the lug plate 41 to the spring guide 40. The installed force of spring 38 serves to keep the assembled anti-backing quick-release device 36 in a collapsed position. To install brush assembly 43 onto the rotary power source 1 of powered chassis 100*a*, the lugs of the anti-backing device are aligned with the lugs of transmission 1*a*, once aligned, the brush assembly can be pressed into place and rotated in the appropriate direction to engage the wedge-action clutch 20. When installed into the powered brush assembly 28, the lugs of anti-backing lug plate 41 are held by springs 38 and guide plate 39 in the space that is normally needed to disengage the wedge-action clutch 20 and remove the brush assembly. Removal of the brush assembly 43 is achieved by slightly disengaging the wedge action-clutch 20 and then pulling the spring-loaded lug plate 41 outward to clear the lugs of transmission 1*a*, then while still holding the lug plate 41 outward, rotate the brush to its stop and remove it from the rotary power source 1 of powered chassis 100*a*.

FIG. 21 through 24 demonstrate varied improved electrical motor control systems that contain the upper handle through the power source to motor. As more particularly shown in FIGS. 25-27, the location of such components on the system are placed assembled and arranged. The improved electrical system s may allow for the unit to be used outdoors, by provided additional safety to the user. Safety interlock 301 requires a manual override of the safety feature to turn the system on. A cord keeper 302 may be used to control the system and auto-shut off should the user be removed from the unit in use. Operator switch control 305 turns unit on. A DC battery may be used to power controller 400 within top 304. Low voltage may be provided from the controller to activate the motor via removable harness 303. Motor assembly may include a typical electrical plug, such as a 120 VAC 3-prong male connector. This is preferably separate from a DC supply from controller. Outside power source (e.g via plug) powers motor and is attached via leads to motor assembly. A solid-state relay is preferable to allow a very small power unit to switch on motor via input from controller. An AC/DC converter may be used to allow external power source to power and/or charge handle controller and/or DC battery.

I claim:

1. A modular maintenance system comprising:

a. a first powered brush assembly comprising a clutch for coupling to a transmission;

b. a transmission to rotationally drive said first powered brush assembly;

c. a motor coupled to said transmission to provide rotational power for said first powered brush assembly; said motor driven by a power source;

d. a first chassis supporting a rotation limiting feature, said first rotation limiting feature of said first chassis being slidably coupled with said motor;

e. a second chassis supporting a second rotation limiting feature, said second rotation limiting feature being slidably coupled to a weight similar in mass to said motor;

f. a rotating spindle fixedly coupled with said weight of said second chassis;

g. a second driven brush assembly engagedly coupled with said first powered brush assembly and adapted to rotate based on a rotation of said first powered brush assembly; said second driven brush assembly adapted to mount on said spindle of said second chassis; and h. a handle coupled to both of said first and second chassis, said handle comprising a controller to operate said motor, said handle further comprising a switch to operate said controller.

2. The system of claim 1 wherein said handle is removable from both of said first and second chassis, and mountable onto said first chassis.

3. The system of claim 2 wherein said second chassis is disengaged from said first chassis, and said first powered brush assembly is operated separably from said second driven brush assembly.

4. The system of claim 1 wherein said first powered brush assembly comprises a clutch to couple said first brush assembly to said transmission, and a quick release adapted to maintain said clutch in connection with said transmission.

5. The system of claim 1 wherein both of said controller and said motor of said first chassis are communicatively coupled with a solid state relay, and said controller is additionally communicatively coupled with a low voltage DC power source.

6. The system of claim 5 wherein said low voltage DC source is an AC/DC converter, wherein power is simultaneously supplied to said solid state relay and said AC/DC converter by an external AC source, and said controller is powered directly by said AC/DC converter, and said solid state relay is activated via said controller, and said motor is indirectly powered by said external AC source via said solid state relay.

7. The system of claim 5 wherein said low voltage DC source is an on-board, replaceable DC battery, wherein power is supplied to said solid state relay by an external AC source, and said controller is powered directly by said DC battery, and said solid state relay is activated via said controller, and said motor is indirectly powered by said external AC source via said solid state relay.

8. The system of claim 1 wherein said first and second rotation limiting feature of both said first and second chassis comprise a suspension feature to offset the combined mass of said motor, said transmission, said first powered brush assembly, said weight, said spindle, and said second driven brush assembly.

9. The system of claim 8 wherein said suspension feature is adjustable with at least two preset configurations.

10. The system of claim 9 wherein said suspension feature comprises a passive, wear compensating system with multiple springs.

11. The system of claim 8 wherein said suspension feature comprises a passive, wear compensating system with multiple springs.

12. A modular maintenance system comprising:

a. a first powered brush assembly comprising a clutch for coupling to a transmission;

b. a transmission to rotationally drive said first powered brush assembly;

c. a motor coupled to said transmission to provide rotational power for said first powered brush assembly; said motor driven by a power source;

d. a first chassis supporting a rotation limiting feature, said first rotation limiting feature of said first chassis being slidably coupled with said motor;

e. a second chassis supporting a second rotation limiting feature, said second rotation limiting feature being slidably coupled to a weight similar in mass to said motor;

f. a rotating spindle fixedly coupled with said weight of said second chassis;

g. a second driven brush assembly engagedly coupled with said first powered brush assembly and adapted to rotate based on a rotation of said first powered brush assembly; said second driven brush assembly adapted to mount on said spindle of said second chassis; and h. a handle coupled to both of said first and second chassis, said handle comprising a controller to operate said motor, said handle further comprising a switch to operate said controller;

wherein power is supplied to said controller from an external AC source, and said motor of said first chassis is powered indirectly by said external AC source via said controller.

* * * * *